US006455240B1

(12) United States Patent
Adams et al.

(10) Patent No.: US 6,455,240 B1
(45) Date of Patent: Sep. 24, 2002

(54) METHOD FOR SIMULTANEOUSLY COATING A NON-GELATIN LAYER ADJACENT TO A GELATIN-CONTAINING LAYER

(75) Inventors: Ryan B. Adams, Rochester; Lloyd A. Lobo, Webster; Mridula Nair, Penfield; David C. Boris, Webster; Kevin M. Donovan, Bergen, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/844,165

(22) Filed: Apr. 27, 2001

(51) Int. Cl.[7] ..... G03C 1/74; G03C 1/815; G03C 11/22; B05D 1/30

(52) U.S. Cl. ..... 430/512; 430/531; 430/533; 430/536; 430/539; 430/935; 430/961; 427/420

(58) Field of Search ..... 430/539, 935, 430/531, 536, 533, 512, 961; 427/420

(56) References Cited

U.S. PATENT DOCUMENTS 5,306,527 A * 4/1994 Kurtz et al. ..... 427/420
5,306,537 A 4/1994 Gustafson et al. ..... 428/141
5,310,637 A 5/1994 Kuz et al. ..... 430/935
5,856,051 A 1/1999 Yau et al. ..... 430/537
6,194,130 B1 2/2001 Nair et al. ..... 430/961

OTHER PUBLICATIONS

Jones et al., "Protective Ovrcoat For Photographic Elements", USSN 09/621,267, (Attorney Docket No. 80609), filed Jul. 21, 2000.

* cited by examiner

*Primary Examiner*—Richard L. Schilling
(74) *Attorney, Agent, or Firm*—Chris P. Konkol

(57) ABSTRACT

A method of reducing the tendency toward formation of coating non-uniformities in the coating of multilayer photographic elements is disclosed. More particularly, the present invention involves the coating of a non-gelatin coating over a topmost gelatin layer in a photographic element. In one embodiment, a processing-solution-permeable overcoat is simultaneously coated with the emulsion layers onto a photographic substrate, which overcoat becomes water and stain resistant in the photochemically processed product. In the latter embodiment, the overcoat formulation comprises at least one water-dispersible hydrophobic polymer interspersed with a water-soluble polymer.

25 Claims, 2 Drawing Sheets

METHOD FOR SIMULTANEOUSLY COATING A NON-GELATIN LAYER ADJACENT TO A GELATIN-CONTAINING LAYER

FIELD OF THE INVENTION

The present invention relates to an improved method of coating multilayer liquid packs on moving webs involved in the manufacture of photographic elements. More particularly, the present invention involves the coating of a non-gelatin overcoat over a topmost gelatin layer in a photographic element. In one embodiment, a processing-solution-permeable overcoat is simultaneously coated with the emulsion layers onto a photographic substrate, which overcoat becomes water and stain resistant in the photochemically processed product.

BACKGROUND OF THE INVENTION

In many instances it is desired to coat the surface of an object with a plurality of distinct, superposed layers (collectively, the plurality of layers is also known as a coating pack). In the manufacture of photographic elements, such as photographic film, wherein a number of layers (up to ten or more) of different photographic coating compositions must be applied to a suitable support in a distinct layered relationship, the uniformity of thickness of each layer in the photographic element must be controlled within very small tolerances. Common methods of applying photographic coating compositions to suitable supports involve simultaneously applying the superposed layers to the support. Typically, a coating pack having a plurality of distinct layers in face-to-face contact is formed and deposited on the object so that all the distinct layers are applied in a single coating operation. In the photographic industry, several such coating operations may be performed to produce a single photographic element. Several methods and apparatus have been developed to coat a plurality of layers in a single coating operation. One such method is by forming a free falling, vertical curtain of coating liquid which is deposited as a layer on a moving support Exemplary "curtain coating" methods of this type are disclosed in U.S. Pat. No. 3,508,947 to Hughes, U.S. Pat. No. 3,632,374 to Grieller, and U.S. Pat. No. 4,830,887 to Reiter. "Bead coating" is another method of applying a plurality of layers to a support in a single coating operation. In typical bead coating techniques, a thin liquid bridge (a "bead") of the plurality of layers is formed between, for example, a slide hopper and a moving web. The web picks up the plurality of layers simultaneously, in proper orientation, and with substantially no mixing between the layers. Bead coating methods and apparatus are disclosed, for example, in U.S. Pat. Nos. 2,681,294 and 2,289,798.

U.S. Pat. Nos. 5,306,527 and 5,310,637 disclose methods of reducing the tendency toward formation of ripple imperfections in the coating of multilayer photographic elements. In U.S. Pat. No. 5,310,637, it is stated that ripple or ripple imperfection is defined for the purposes of this invention as a layer thickness nonuniformity resulting from wave growth at the fluid-fluid interfaces of a plurality of layers due to a hydrodynamic instability of the gravity-induced flow of the plurality of layers on a coated web. The patent theorizes that ripple imperfections arise when there are viscosity differences between adjacent layers of multilayer coating packs. These viscosity differences can be introduced in a variety of ways, including initial viscosity differences between the various layers as delivered to the web or changes in relative layer viscosities from thermal effects after the layers are coated on a web. Another theorized cause was interlayer mass transport of solvent, for example, in the coating of photographic elements, where adjacent layers often contain varying amounts of gelatin. It was thought that these differences cause water diffusion between the layers which, in turn, can significantly alter the resulting viscosities of the individual layers after they are coated on the web. In this way, viscosity disparities between layers may be introduced on the web for layers which were originally coated at nominally equal viscosities. It was also stated that an osmotic pressure difference between adjacent layers drives interlayer water diffusion in gelatin-containing multilayer coating packs, such as commonly used in the photographic industry and that, in many cases, osmotic pressure differences may result from significant differences in the layer concentrations of gelatin and other addenda. The patent further teaches that the tendency toward the formation of ripple imperfections in multilayer coatings can be reduced by controlling the gelatin concentration of adjacent layers. For example, in a multilayer coating pack having upper, middle, and lower gelatin-containing layers, respectively, the patent concludes that the tendency toward the formation of ripple will be greatly reduced if the middle layer has a gelatin concentration within three weight percent of the gelatin concentration of each of the upper and lower layers and each of the layers has a viscosity which differs from a norm by no more than fifteen percent. U.S. Pat. No. 5,306,537 teaches methods of coating multilayer gelatin based coating packs in which the compositions are determined according to a given formula to keep the ripple value below 35. This formula includes maintaining certain viscosity ratios between adjacent layers. In a gelatin-based coating, maintaining similar viscosities is typically achieved by maintaining similar gelatin concentrations. As a result, inherently the osmotic pressures are naturally kept close and prevent instability problems.

In both bead coating and curtain coating methods, it is necessary to set and/or dry the layered coating after it has been applied to the support. To accomplish this, the web is typically conveyed from the coating application point to a chill section. Subsequently, the web is conveyed through a series of drying chambers after which it is wrapped on a winder roll. Space constraints for the coating machine, cost considerations, and flexibility of design may dictate that one or more inclined web paths be present in conveying the coated substrate from the coating point to the chill section and drying chambers.

Advancements in coating technology have led to increased numbers of layers coated at each coating station, increased total pack thickness per station, thinner individual layers, use of rheology-modifying agents, and the development of new, sophisticated chemistries. In addition, a multilayer photographic coating can consist of sensitizing layers and/or additional, non-imaging, layers. As a result, the chemical composition of the multilayer coating pack is often markedly different from one layer to the next.

A number of patents have been directed to water-resistant protective coatings that can be applied to a photographic element prior to development. For example, U.S. Pat. No. 2,706,686 describes the formation of a lacquer finish for photographic emulsions, with the aim of providing water- and fingerprint-resistance by coating the light-sensitive layer, prior to exposure, with a porous layer that has a high degree of water permeability to the processing solutions. After processing, the lacquer layer is fused and coalesced into a continuous, impervious coating. More recently, U.S.

Pat. No. 5,853,926 to Bohan et al. discloses a protective coating for a photographic element, involving the application of an aqueous coating comprising polymer particles and a soft polymer latex binder. This coating allows for appropriate diffusion of photographic processing solutions, and does not require a coating operation after exposure and processing. Again, however, the hydrophobic polymer particles must be fused to form a protective coating that is continuous and water-impermeable.

U.S. Pat. No. 5,856,051 describes the use of hydrophobic particles with gelatin as the binder in an overcoat formulation. This invention demonstrated an aqueous coatable, water-resistant protective overcoat that can be incorporated into the photographic product, allows for appropriate diffusion of photographic processing solutions, and does not require a coating operation after exposure and processing. The hydrophobic polymers exemplified in U.S. Pat. No. 5,856,051 include polyethylene have a melting temperature (Tm) of 55 to 200° C., and are therefore capable of forming a water-resistant layer by fusing the layer at a temperature higher than the Tm of the polymer after the sample has been processed to generate the image. The coating solution is aqueous and can be incorporated in the manufacturing coating operation without any equipment modification. Again, however, fusing is required by the photofinishing laboratories to render the protective overcoat water-resistant. Similarly, commonly assigned U.S. Ser. No. 09/353,939 and U.S. Ser. No. 09/548,514, respectively, describe the use of a polystyrene-based material and a polyurethane-based material, with gelatin as the binder, in an overcoat for a photographic element, which overcoat can be fused into a water resistant overcoat after photographic processing is accomplished to generate an image.

Commonly assigned U.S. Ser. No. 09/235,436 discloses the use of a processing solution permeable overcoat that is composed of a urethane-vinyl copolymer having acid functionalities. Commonly assigned U.S. Ser. No. 09/235,437 and U.S. Pat. No. 6,194,130 B1 disclose the use of a second polymer such as a gelatin or polyvinyl alcohol to improve processibility and reduce coating defects. However, it has been found that in order to achieve the functionality of water impermeability, it is undesirable to have gelatin in the overcoat, since the second polymer is expected to exit the imaging element upon processing, and gelatin, being crosslinkable, does not exit the coating. Commonly assigned U.S. Ser. No. 09/621,267 discloses the use of a processing solution permeable overcoat that is composed of various non-gelatin containing hydrophobic polymers in combination with a hydrophilic polymer.

While the prior art has disclosed imaging elements with a processing permeable overcoat that is rendered water impermeable, and the materials used to prepare such overcoats, it has not been specific in how these imaging elements have been prepared. The desired overcoat may be applied in several possible methods. It may be applied to a imaging element that is previously coated with all layers except the overcoat. In such a case, the overcoat may be applied as a single layer. It also could be applied in a single coating operation, in a tandem method. In this case all the layers, except the desired overcoat can be applied at a first station in the coating machine. The web is then dried and run through a second coating station, without winding it up, where the overcoat is applied.

The most preferred method for coating an overcoat is at a single coating station, along with the other imaging layers. This is typically accomplished with gelatin overcoats using a slide hopper where multiple solutions are layered without mixing. The layered solutions are then deposited on the web either by bead coating or by dropping it as a curtain onto the web.

PROBLEM TO BE SOLVED BY THE INVENTION

The present invention addresses this problem and discloses a method of reducing the likelihood and severity of coating non-uniformities in coating multilayer liquid packs in the photographic industry. In particular, it has been found that when attempting to simultaneously coat at least one non-gelatin-containing layer adjacent to a gelatin-containing layer can often result in coating non-uniformities.

According to another more specific aspect of the invention, it would also be desirable to allow a polymeric latex protective overcoat to be coated simultaneously with underlying emulsion layers in a so-called single pass operation, during manufacture of a photographic imaging element, as compared to a so-called "two-pass" coating operation. Thus, it would also be desirable to obtain an imaging element comprising an overcoat that is process-permeable during photoprocessing and which can be converted to a water-resistant protective overcoat for the imaged element, which water resistance is not lost or decreased when the overcoat is simultaneously coated with the emulsion layers. It would be further desirable if this could be accomplished without the addition of laminating or fusing steps, without the need for high temperature fusing, and preferably with minimal or no additional equipment to carry out photoprocessing.

SUMMARY OF THE INVENTION

In accordance with the present invention, it has been discovered that coating non-uniformities can occur in multilayer coating packs when there are osmotic differences between a non-gelatin-containing layer and a gelatin-containing layer, which non-gelatin-containing layer is overlying and adjacent to the gelatin-containing layer, after coating those layers on a moving web. The present invention enables the design and use of coating compositions that exhibit a greatly reduced tendency toward the formation of coating non-uniformities. The present invention helps obviate a significant coating problem that will become increasingly prevalent, especially in the photographic industry, stemming from the development and use of new, non-gelatin-containing layers.

In particular, this invention relates to a method of simultaneously coating at least one non-gelatin-containing layer over and adjacent to a topmost gelatin-containing layer, which layered mass further comprises at least one silver-halide emulsion layer, wherein the osmotic pressure of the of the non-gelatin layer is not more than 30 percent less than the osmotic pressure of the gelatin-containing layer, as measured by standard device. More than one non-gelatin-coating layer can overlie the topmost gelatin-containing layer, and the layers can be on the frontside or backside of the photographic element. In a preferred embodiment, the osmotic pressure of the non-gelatin-containing layer is less than the osmotic pressure of the gelatin-containing layer.

It has been found that polymer latex coating formulations will commonly have low osmotic pressures which account for coating stability problems. Without being bound by theory, it is believed that this happens because of osmotic pressure mismatches between adjacent layers result in water moving from one layer to another. This results in changes in the concentrations of components in the layers, in turn resulting in viscosity changes that can cause coating instabilities as described in prior art. In polymeric systems, one primary way of controlling osmotic pressure is with the addition of a water soluble polymer. Along with gelatin-containing layers, multiple polymer layers may be coated simultaneously with the purpose of imparting different physical properties from each layer. One example is one layer for a moisture barrier and one for a high gloss surface.

In another aspect of the invention, the method is used to simultaneously coat a photographic imaging element in which the overcoat can be converted into a water-resistant coating. In particular, it has been found that stain resistance and/or water resistance of an imaged element having a protective overcoat, which is the topmost non-gelatin layer on the frontside of the photographic element, can be obtained or enhanced, when the overcoat (nascently protective) is coated simultaneously with the gelatin-based emulsion layers, by controlling the osmotic pressure of the layers so that the osmotic pressure of the non-gelatin-containing layer is not more than 30 percent less than the osmotic pressure of the gelatin-containing layer, as measured by a standard device described below. For example, such a photographic element may comprise a support, at least one silver-halide emulsion layer superposed on the support, and overlying the silver-halide emulsion layer, a processing-solution-permeable protective overcoat composition that can be incorporated into or coated on the imaging element during manufacturing and that does not inhibit photographic processing. The non-gelatin containing layer according to the present invention comprises water dispersible polymer particles in a latex form or a conventional colloidal dispersion of a hydrophobic film forming material along with a water soluble polymer. The presence of a water soluble component that is substantially washed out during processing allows photographic processing to proceed at an acceptable rate. The washing out of the water soluble component facilitates the coalescence of the polymer particles to form a continuous protective overcoat in the final product.

In one embodiment of the invention, the overcoat composition applied to the imaging element comprises 30 to 95 weight percent, based on the dry laydown of the overcoat, of water-dispersible polymer particles having an average particle size of between 0.01 to 0.5 micrometers, said water-dispersible polymer being characterized by a $T_g$ (glass transition temperature) of between −40 and $80^0$ C. In general, the overcoat composition preferably contains a water-soluble, hydrophilic polymer that is typically non-crosslinked to facilitate its washing out during processing and, at least to some extent, to facilitate the coalescence of the water-dispersible polymer particles. Preferably, the overcoat formulation is substantially gelatin-free, comprising less than 5% crosslinked gelatin by weight of solids.

In another embodiment of the invention, the overcoat composition applied to the imaging element comprises 5 to 70% by weight of solids of water-soluble hydrophilic polymer such that more than 30 weight percent of the water-soluble polymer is washed out during photographic processing; wherein the weight ratio of the water dispersible polymer particles to the non-crosslinked water soluble polymer is between 60:40 to 85:15 and whereby the overcoat forms a water-resistant overcoat after photoprocessing without fusing.

DESCRIPTION OF THE PREFERRED EMBODIMENTS

Figure 1:
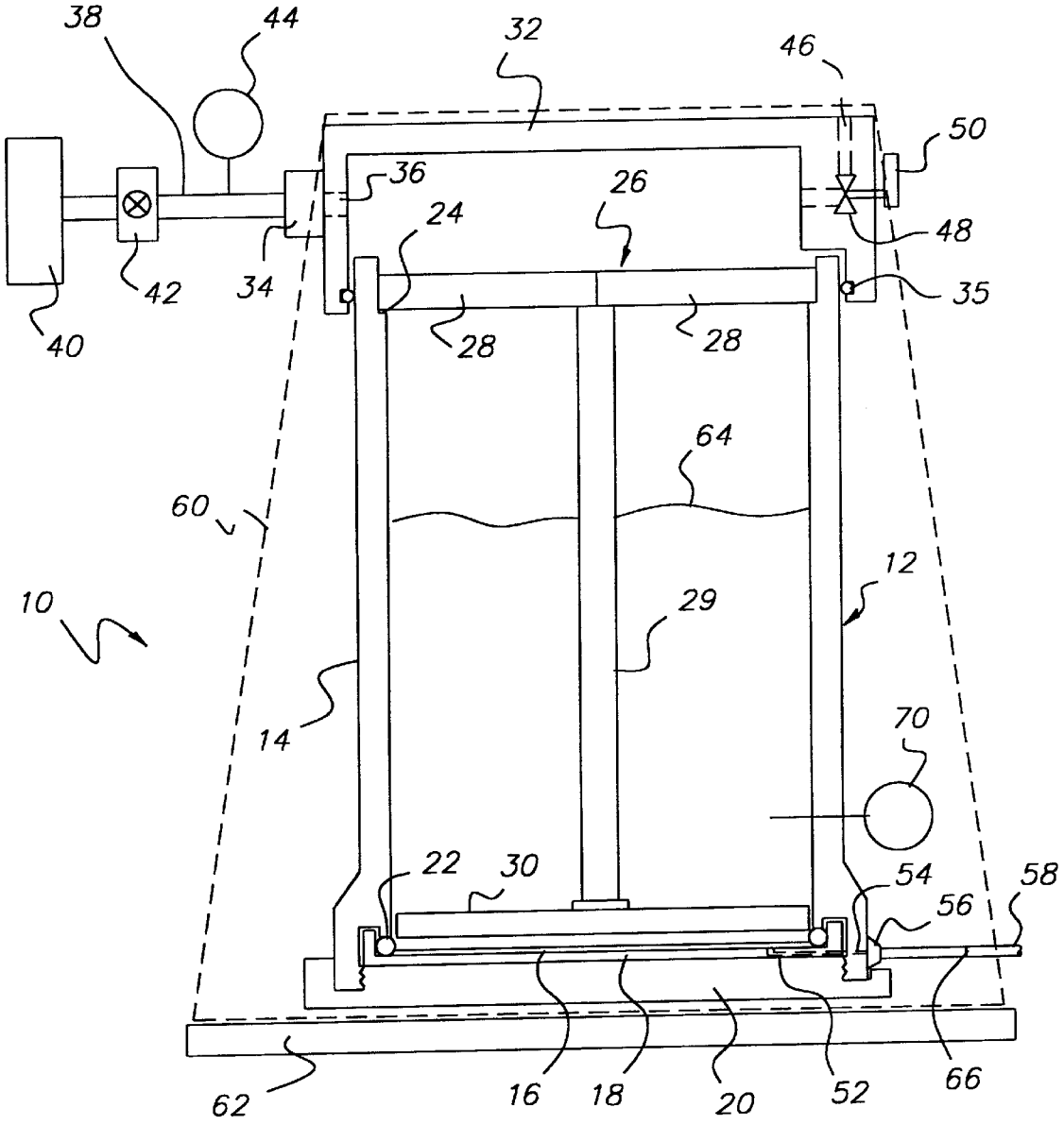
FIG. 1 shows a cross-sectional view of a stirred cell osmometer for measuring the osmolality of the coating compositions in practicing the method of the present invention.

The present invention provides a simple and inexpensive way to manufacture photographic elements containing non-gelatin-containing layers comprising latex particles.

As indicated above, the method and apparatus of this invention are especially useful in the photographic art for manufacture of multilayer photographic elements, i.e., elements comprised of a support coated with a plurality of superposed layers of photographic coating composition. The number of individual layers can range from two to as many as ten or more. In the photographic art, the liquid coating compositions utilized are of relatively low viscosity, i.e., viscosities from as low as about 2 centipoise to as high as about 150 centipoise, or somewhat higher, and most commonly in the range from about 5 to about 100 centipoise. Moreover, the individual layers applied must be exceedingly thin, e.g., a wet thickness which is a maximum of about 0.015 centimeter and generally is far below this value and can be as low as about 0.0001 centimeter. In addition, the layers must be of extremely uniform thickness, with the maximum variation in thickness uniformity being plus or minus five percent and in some instances as little as plus or minus one percent. In spite of these exacting requirements, the method of this invention is of great utility in the photographic art since it permits the layers to be coated simultaneously while maintaining the necessary distinct layer relationship and fully meeting the requirements of extreme thinness and extreme uniformity in layer thickness.

In one aspect of the invention, the non-gelatin-containing layer provides water, stain and abrasion resistance of processed photographic elements. The protective overcoat is applied over the photographic element prior to exposure and processing. In particular, a overcoat formulation according to the present invention is applied to the emulsion side of photographic products, particularly photographic prints, which may encounter frequent handling and abuse by end users.

The term "photographic" normally refers to a radiation sensitive material, but not all of the layers presently applied to a support in the manufacture of photographic elements are, in themselves, radiation sensitive. For example, subbing layers, pelloid protective layers, filter layers, antihalation layers, and the like are often applied separately and/or in combination and these particular layers are not radiation sensitive. The invention includes within its scope all radiation sensitive materials, including electrophotographic materials and materials sensitive to invisible radiation as well as those sensitive to visible radiation. While, as mentioned hereinbefore, the layers are generally coated from aqueous media, the invention is not so limited since other liquid vehicles are known in the manufacture of photographic elements and the invention is also applicable to and useful in coating from such liquid vehicles. More specifically, the photographic layers coated according to the method of this invention can contain light sensitive materials such as silver halides, zinc oxide, titanium dioxide, diazonium salts, light-sensitive dyes, etc., as well as other ingredients known to the art for use in photographic layers, for example, matting agents such as silica or polymeric particles, developing agents, mordants, and materials such as are disclosed in U.S. Pat. No. 3,297,446. The photographic layers can also contain various hydrophilic colloids. Illustrative of these colloids are proteins (e.g., protein or cellulose derivatives), polysaccharides (e.g., starch), sugars (e.g. dextran), plant gums, synthetic polymers (e.g., polyvinyl alcohol, polyacrylamide, and polyvinylpyrrolidone), and other suitable hydrophilic colloids such as are disclosed in U.S. Pat. No. 3,297,446. Mixtures of the aforesaid colloids may be used, if desired.

By the term "water-resistant" is meant herein after ordinary photoprocessing and drying, the overcoat does not imbibe water or prevents or minimizes water-based stains from discoloring the imaged side of the photographic element. By the term "non-crosslinked gelatin" is meant gelatin that is water soluble.

By the term "elevated temperature", as used in this application, to dry and/or facilitate coalescence of the water-dispersible polymer, is herein meant a temperature of from 30 to 100° C. In one embodiment of the present invention, to improve the properties of a protective overcoat, the term "coalescing temperature" refers to an elevated temperature of over 160° F., preferably between 160 and 212° F., more preferably 170 to 200° F., most preferably 180 to 195° F. In contrast, fusing typically requires a pressure roller or belt and drying of the imaged element before fusing. Fusing, which involves simultaneously applied heat and pressure, for example by means of a nip between two rollers, generally requires higher temperatures, typically above the boiling point of water, usually above 100° C. For that reason, fusing normally is applied to an imaged element only after drying.

As mentioned above, the invention relates to a method of simultaneously coating at least one non-gelatin-containing layer over and adjacent to a topmost gelatin-containing layer. By the term "over" is meant that the non-gelatin layer is farthest from the support and the gelatin layer is closer to the support. By the term "topmost layer" is meant the layer furthest from the support. By the term "adjacent" is meant that the two layers are contiguous and there are essentially no intermediary layers. By the term "frontside" is meant on the viewing side of the photographic support; by the term "backside" is meant on the side of the support opposite to the silver-halide emulsion layers. According to the invention, the osmotic pressure of the of the non-gelatin layer is not more than 30 percent less than the osmotic pressure of the gelatin-containing layer, as measured by a osmometer, described below. In a preferred embodiment, the osmotic pressure of the non-gelatin-containing layer is less than the osmotic pressure of the gelatin-containing-layer. Preferably, the osmotic pressure of the gelatin layer is not more than 25% less, most preferably not more than 20% less than the osmotic pressure of the gelatin-containing layer, as measured by an osmometer described below.

It has been found that polymer latex coating formulations will commonly have low osmotic pressures which account for coating stability problems. Without being bound by theory, it is believed that this happens because of osmotic pressure mismatches between adjacent layers result in water moving from one layer to another. This results in the changes in the concentration of the layers and viscosity changes accordingly which can cause coating instabilities as described in prior art. In polymeric systems, one primary way of controlling osmotic pressure is with the addition of a water soluble polymer. Along with gelatin-containing layers, multiple polymer layers may be coated simultaneously with the purpose of imparting different physical properties from each layer. One example is one layer for a moisture barrier and one for a high gloss surface.

Osmotic pressure of a solution is defined as the applied pressure required to prevent passage of dialyzate fluid across a membrane. Dialyzate comprises all the species which pass through a membrane of a given pore size, as measured by the molecular weight cut off. The osmotic pressure is typically governed by the molecular weight of the solutes and their respective concentration and the molecular-weight cutoff of the membrane. Typically, the osmotic pressure of the non-gelatin layer is 0.5 to 10 psi, preferably 3 to 10.

In accordance with the invention, for reproducible and accurate results, the osmotic pressure should be measured by an osmometer now to be described. Turning first to FIG. 1, there is shown a schematic perspective view of an osmometer 10 that includes a sample cell 12. Sample cell 12 includes a chamber body 14 which is preferably made of polysulfone and is preferably transparent. An AMICON 8400 stirred cell dialysis chamber serves well as sample cell 12. Residing in chamber body 14 is membrane 16. For aqueous solutions a polysulfone DIAFLO ultrafiltration membrane YM1 (1000 Mw cut-off) was used for membrane 16. For the purposes of this invention, related to the coating defects observed, a 1000 Mw cut off membrane verifiably equivalent to the polysulfone DIAFLO ultrafiltration membrane YM1 (1000 Mw cut-off) must be used. The DIAFLO YM1 membrane is suitable for most organic solvents as well, excluding Amines, phenols and solutions with pH less than 3 or greater than 13. (The osmotic pressure recorded depends upon the membrane chosen. Other membranes with tighter (or looser) pores would selectively measure the osmotic contribution of lower (or higher) molecular weight components of the sample solution.)

Membrane 16 is supported on meandering dialyzate cell 18. Meandering dialyzate cell 18 is retained in chamber body 14 by means of base plate 20 that threadably engages chamber body 14. An O-ring 22 provides a seal between chamber body 14 and meandering dialyzate cell 18. There is a circumferential lip 24 in the interior surface of chamber body 14. Circumferential lip 24 provides residence for support bracket 26 that preferably includes three radial spokes 28. Extending down from support bracket 26 is stir rod axle 29. Rotatably mounted on stir rod axle 29 is stir rod blade 30.

Press fit onto the top of chamber body 14 is lid 32. A seal between lid 32 and chamber body 14 is provided by means of O-ring 35. Attached to lid 32 is bushing 34 that aligns with bore 36 in lid 32. Extending from bushing 34 is pressurized gas conduit 38 for which pressurized gas is supplied from a pressurized gas source 40. Mounted in pressurized gas conduit 38 is a pressure regulator 42 and a pressure gauge 44. Lid 32 is also provided with an L-shaped bore 46 in which a pressure relief valve 48 is mounted. Pressure relief valve 48 is manually operated by means of handle 50.

Figure 2:
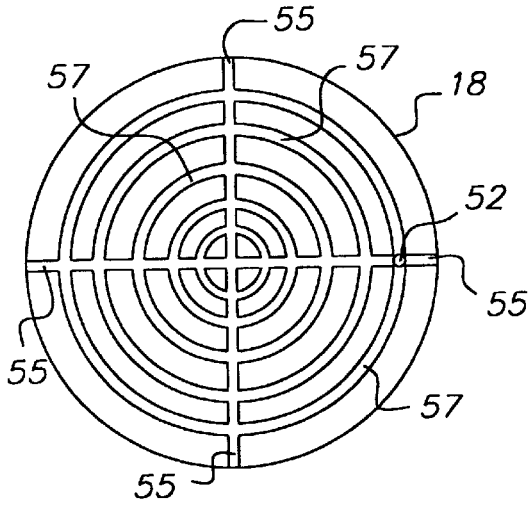
FIG. 2 shows a upper plan view of the low pressure side support for the membrane used in the apparatus of FIG. 1.

Referring now to FIG. 2, there is a bore 52 into meandering dialyzate cell 18 which communicates with one of radial channels 55 in the top surface of meandering dialyzate cell 18. The top surface of meandering dialyzate cell 18 also includes a series of concentric channels 57 therein. Bore 52 aligns with bore 54 through chamber body 14. Coupling 56 mounts to chamber body 14 at bore 54 and transparent dialyzate exit tube 58 extends therefrom.

Figure 3:
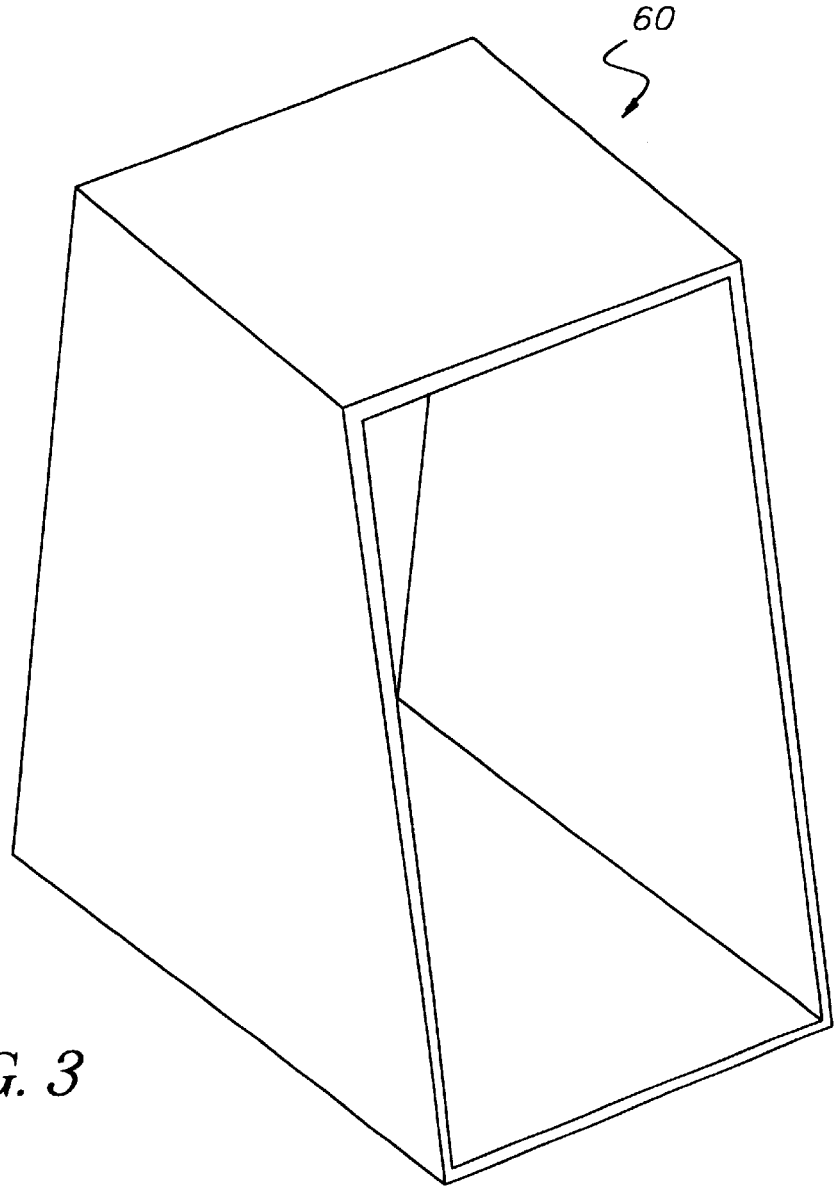
FIG. 3 is a metal clamp for the stirred cell osmometer of FIG. 1.

When in operation, sample cell 12 resides in frame 60 (shown in a perspective view in FIG. 3) which is preferably open on at least two sides thereof to permit observation of sample cell 12. Frame 60 is made of metal (preferably steel) and insures that lid 32 is retained on chamber body 14 when sample cell 12 is pressurized via pressurized gas conduit 38. The stir bar can be activated by placing the whole assembly on a magnetic stir plate. It is critical that the stirring be carried out during measurement, in order to minimize concentration polarization at the membrane surface, and thus, to minimize error in the osmotic pressure measurement.

Initially the pressurizing lid 32 is removed and the sample solution 64 is introduced into the chamber 14 above the membrane 16. The gas delivered via pressurized gas conduit 38 can be air, nitrogen or a non-interacting (inert) gas. Preferably, pressurized gas source 40 can deliver gas at a relatively high pressure (80 psi). The air pressure applied to the sample solution 64 is controlled by the pressure regulator 42 that has the capability of smoothly varying the pressure over the entire desired range of measurement (0–10 psi). Pressure regulators with more or less sensitivity can be chosen based upon the osmotic pressure of the sample solution being measured and the desired accuracy. Two examples of pressure gauges can be used in the operation of the present invention are the NULLMATIC 40–30 pressure regulator and the ASHCROFT 40 psi pressure regulator. The applied pressure is measured on pressure gauge 44. The accuracy and range of the osmometer 10 depends on the accuracy and pressure range of the pressure gauge 44 selected. A gauge capable of 0.01 psi accuracy will suffice.

The sample cell 12 plus solution 64 is weighed and then the lid 32 is sealed with the pressure release valve 48 open. The sealed sample cell 12 is then placed inside the metal pressure frame 60 and the pressure release valve 48 is closed. This frame 60 holds the lid 32 firmly in place under pressurization. It is critical to measure the osmotic pressure at the temperature of the solution at the coating station. Changes in solution temperature can be accomplished by heating the cell via the frame using the hot plate of the magnetic stirrer, or by immersing the whole cell in a water bath.

The pressure is raised initially to between 5 and 15 psi to wet the membrane 16 with the sample solution 64. Once the sample solution 64 is forced through the membrane 16 and the dialyzate begins to emerge through the transparent dialyzate exit tube 58, such that there is a visible meniscus 66 therein, the pressure is reduced using the pressure regulator 42 until flow ceases. Pressure is reduced further until flow reverses direction and the dialyzate is drawn back into the meandering dialyzate cell 18 and ultimately back through the membrane 16 into the transparent sample chamber 14. Finally, the pressure is varied carefully until the meniscus 66 in the dialyzate exit tube 58 holds substantially stationary, that is, stationary over a few minute time period. The osmotic pressure of the sample solution 64 is equal to the applied gas pressure read upon the pressure gauge 44 when the flow is substantially stationary, that is when equilibrium across the membrane is reached. The osmotic pressure measured is then corrected for the slight hydrostatic pressure difference calculated from the difference in height of the liquid column in the dialyzate exit tube 58, and the height of the sample surface 64 in the sample cell 12 (typically this correction is between 1 and 10 centimeters of water). Increased accuracy in low pressure applications can be accomplished by suspending the dialyzate tube vertically and measuring the difference in heights of the stationary meniscus of the dialyzate tube 66, and the height of the sample surface 64 in the sample cell 12. The osmotic pressure is then calculated by correcting the gauge pressure for the hydrostatic pressure difference. Preferably, the step of measuring the difference in heights of the stationary meniscus 66 in the dialyzate tube 58, and the height of the sample surface 64 in the sample cell 12 is performed at two or three applied pressures typically differing by a few centimeters of water (1–5 cm). The osmotic pressure is then calculated by correcting the gauge pressure for the hydrostatic pressure difference for each chosen pressure.

The above-described membrane osmometer is described fully in patent application Ser. No. 09/437,071, hereby incorporated by reference in its entirety. To summarize the above, osmolality is measured as follows. It is noted that the temperature at which the osmotic pressure is to be measured must match the temperature at which the solution is to be coated. To insure isothermal conditions, the osmometer was submersed and allowed to equilibrate in a constant temperature water bath at 105° F. during all measurements. The magnetic stir bar was set at ~1–3 rev/second to sweep the DIAFLO Ultrafiltration Membrane YM1 (1000 Mw cut-off) membrane surface clean and avoid surface concentration gradients. Air pressure in excess of the osmotic pressure of the solution was applied (5–10 psi) until dialyzate emerged into the transparent dialyzate capillary tube. The applied pressure was then reduced and varied until the dialyzate meniscus was stable, indicating that the applied air pressure matched the osmotic pressure of the solutions. Then the osmotic pressure was read to 0.01 psi accuracy on the air pressure gauge. Using the sample weight, slight corrections were made subtracting the contribution of hydrostatic pressure. Preferably, a standard solution may be tested first to demonstrate that the membrane is not damaged and suitably seated in the device.

The above described osmometer can be used to obtain a reproducible osmolality measurement. However, the present invention is not limited to the use of any particular osmometer or kind of osmometer. Other osmometers can be used that provide reliable and reproducible results, preferably providing results demonstrably equivalent to those obtained as described above. In the event of a discrepancy, between different osmometers, with respect to an osmolality measurement, however, the results obtained with the osmometer described above is determinative. With respect to other devices, large dialyzate/sample cell volume ratios can cause dilution effects especially with salt equilibration that can effect charged polymer and charged colloid osmotic pressure.

As indicated above, the osmotic pressure of the non-gelatin layer is 0.5 to 10 psi, preferably 3 to 10. The osmotic pressure of the gelatin-containing layers typically varies from 0.2 to 12, preferably 3 to 8. The osmotic pressure of the gelatin layer will depend mainly on the gelatin concentration and the pH. It may also depend on the amount of added charged polymer and the dispersion. This may depend on its function.

The non-gelatin layer contains less than 1% gelatin by dry weight, preferably less than 0.5% gelatin, more preferably essentially gelatin free.

Osmotic pressure can be controlled by changing the concentration of species whose MW is larger than the cut-off of the membrane used to measure the osmotic pressure. One method is to add components to increase the osmotic pressure, for example additives such as hydrophilic polymers that do not aggregate in solution. Polymers with ionic species are particularly effective, due the contributions of low MW counter ions that are associated with the polymer in order to maintain electroneutrality of the solution. Macrocolloids with intrinsic charge or absorbed charge will also contribute to osmotic pressure. Preferably, the osmotic pressure of the non-gelatin layer is controlled by increasing the concentration of a water soluble polymer such as polyvinyl alcohol (PVA), polyethylene oxide, polyvinylpyrolidinone polyacrylates. Although, typically the MW does not primarily impact osmotic pressure, it is preferred to use low MW polymers, so that the osmotic pressure can be changed without substantial change in the viscosity of the coating solution, unless such change is so desired. Preferably the water soluble polymers with a number average molecular weight less than 100,000 daltons and more preferable less than 20,000 daltons. In one embodiment PVA, with a number average molecular weight of 12,000 to 15,000 daltons, is used to increase osmotic pressure.

Suitably, the viscosity of the non-gelatin-containing layer when coating is 5 to 250 centipoise, preferably 40 to 150 centipoise. It may also be necessary to add deviscosifying agents and/or thickeners in the present method to bring the viscosities of the compositions within 15% of a norm while maintaining the requisite gelatin percentages in adjacent layers. Deviscosifying agents act to reduce the viscosity of a liquid. Thickeners act to increase the viscosity of a liquid. Rheology modifiers can also be used to effect the viscosity profile. Suitably, the viscosity of the gelatin-containing layer when coating is 5 to 250 centipoise.

To coat the prepared coating compositions, a laminar flow of a layered mass is formed in accordance with the determined conditions. Any suitable method of forming a laminar flow of the photographic compositions is suitable. Preferably, the flow is formed on an inclined plane. A slide hopper of the type conventionally used to make photographic elements is especially useful in the present method. Exemplary methods of forming a laminar flow on a slide hopper are disclosed in U.S. Pat. No. 3,632,374 to Greiller and U.S. Pat. No. 3,508,947 to Hughes, the disclosures of which are hereby incorporated by reference.

The flowing layered mass is received on the moving web at a coating application point. Various methods of receiving the layered mass on the, web can be utilized. Two particularly useful methods of coating the layered mass on the web are bead coating and curtain coating. Bead coating includes the steps of forming a thin liquid bridge (i.e., a "bead") of the layered mass between, for example, a slide hopper and the moving web. An exemplary bead coating process comprises forcing the coating compositions through elongated narrow slots in the form of a ribbon and out onto a downwardly inclined surface.

The coating compositions making up the layered mass are simultaneously combined in surface relation just prior to, or at the time of, entering the bead of coating. The layered mass is picked up on the surface of the moving web in proper orientation with substantially no mixing between the layers. Exemplary bead coating methods and apparatus are disclosed in U.S. Pat. No. 2,761,417 to Russell et al., U.S. Pat. No. 3,474,758 to Russell et al., U.S. Pat. No. 2,761,418 to Russell et al., U.S. Pat. No. 3,005,440 to Padday, and U.S. Pat. No. 3,920,862 to Damschroder et al., the disclosures of which are hereby incorporated by reference.

Curtain coating includes the step of forming a free falling vertical curtain from the flowing layered mass. The free falling curtain extends transversely across the web path and impinges on the moving web at the coating application point. Exemplary curtain coating methods and apparatus are disclosed in U.S. Pat. No. 3,508,947 to Hughes, U.S. Pat. No. 3,632,374 to Greiller, and U.S. Pat. No. 4,830,887 to Reiter, the disclosures of which are hereby incorporated by reference.

After applying the coated layers to the support, it may be dried over a suitable period of time. The layers are generally dried by simple evaporation, which may be accelerated by known techniques such as convection heating. Known coating and drying methods are described in further detail in *Research Disclosure* No. 308119, Published December 1989, pages 1007 to 1008.

The non-gelatin layer in the invention may be required for several functional reasons. Examples of such layers are magnetic layers, antistat layers, sacrificial antiferrotyping layers, abrasion-resistant layers, and other functional layers. In one embodiment of the invention, the function of the non-gelatin layer is to provide a stain-resistant or water-resistant protective overcoat to the imaging element. In this embodiment, the coating solution is primarily composed of dispersions of film forming polymers. The polymers used in this embodiment are latexes or other polymers of any composition that can be stabilized in a water-based medium. Such polymers are generally classified as either condensation polymers or addition polymers. Condensation polymers include, for example, polyesters, polyamides, polyurethanes, polyureas, polyethers, polycarbonates, polyacid anhydrides, and polymers comprising combinations of the above-mentioned types. Addition polymers are polymers formed from polymerization of vinyl-type monomers including, for example, allyl compounds, vinyl ethers, vinyl heterocyclic compounds, styrenes, olefins and halogenated olefins, unsaturated acids and esters derived form them, unsaturated nitriles, acrylamides and methacrylamides, vinyl ketones, multifunctional monomers, or copolymers formed from various combinations of these monomers. Such latex polymers can be prepared in aqueous media using well-known free radical emulsion polymerization methods and may consist of homopolymers made from one type of the above-mentioned monomers or copolymers made from more than one type of the above-mentioned monomers. Polymers comprising monomers which form water-insoluble homopolymers are preferred, as are copolymers of such monomers. Preferred polymers may also comprise monomers which give water-soluble homopolymers, if the overall polymer composition is sufficiently water-insoluble to form a latex. Further listings of suitable monomers for addition type polymers are found in U.S. Pat. No. 5,594,047 incorporated herein by reference. The polymer can be prepared by emulsion polymerization, solution polymerization, suspension polymerization, dispersion polymerization, ionic polymerization (cationic, anionic), Atomic Transfer Radical Polymerization, and other polymerization methods known in the art of polymerization. The selection of water-dispersible particles to be used in the overcoat is based on the material properties one wishes to have as the protective overcoat in addition to water resistance.

The water-dispersible polymer is selected so that fusing is not required, a potentially significant advantage compared to the prior art, for example U.S. Pat. No. 5,856,051, mentioned above.

In a preferred embodiment of the invention, the water-dispersible polymer is a substantially amorphous, thermoplastic polymer having ionized or ionizable groups or moieties in sufficient number to provide water dispersibility prior to coating. In addition to water-resistance, the polymer dispersions in the finally processed product preferably provides further advantageous properties such as good chemical and stain resistance, wet-abrasion resistance, fingerprint resistance, toughness, elasticity, durability, and/or resistance to various oils.

In the case of carboxylic acid ionic groups, the polymer can be characterized by the acid number, which is preferably greater than or equal to 5 and relatively permeable to water at a pH of greater than 7. Preferably, the acid number is less than or equal to 40, more preferably less than or equal to 30. Preferably, the pH of the developing solution is greater than 8, preferably greater than 9. The water-reducible water-dispersible polymer particles comprising ionized or ionizable groups may be branched, unbranched, crosslinked, uncrosslinked.

Optionally, the coating composition in accordance with the invention may also contain suitable crosslinking agents for crosslinking the water-dispersible polymer. Such an additive can improve the adhesion of the overcoat layer to the substrate below as well as contribute to the cohesive strength of the layer. Crosslinkers such as epoxy compounds, polyfunctional aziridines, methoxyalkyl melamines, triazines, polyisocyanates, carbodiimides, polyvalent metal cations, and the like may all be considered. If a crosslinker is added, care must be taken that excessive amounts are not used as this will decrease the permeability of the processing solution. The crosslinker may be added to the mixture of water-dispersible component and any additional polymers.

In one preferred embodiment, the water-dispersible polymers of this invention are polyurethanes, preferably segmented polyurethanes. Polyurethanes are the polymerization reaction product of a mixture comprising polyol monomers and polyisocyanate monomers. A preferred segmented polyurethane is described schematically by the following structure (I):

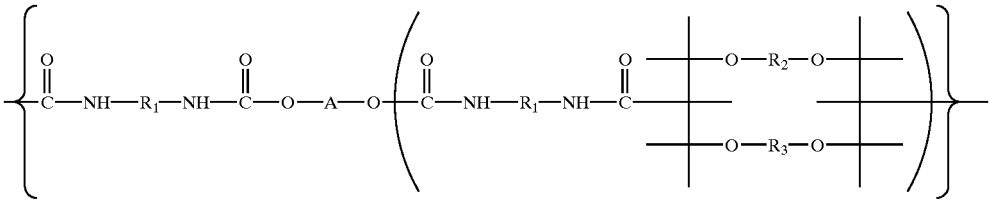

Structure I wherein $R_1$ is preferably a hydrocarbon group having a valence of two, more preferably containing a substituted or unsubstituted, cyclic or non-cyclic, aliphatic or aromatic group, most preferably represented by one or more of the following structures:

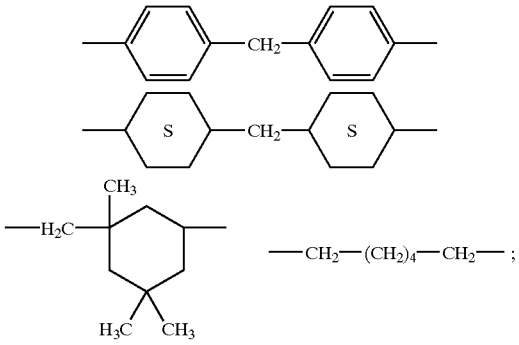

and wherein

A represents a polyol, such as a) a dihydroxy polyester obtained by esterification of a dicarboxylic acid such as succinic acid, adipic acid, suberic acid, azelaic acid, sebacic acid, phthalic, isophthalic, terephthalic, tetrahydrophthalic acid, and the like, and a diol such as ethylene glycol, propylene-1,2-glycol, propylene-1,3-glycol, diethylene glycol, butane-1,4-diol, hexane-1,6-diol, octane-1,8-diol, neopentyl glycol, 2-methyl propane-1,3-diol, or the various isomeric bis-hydroxymethylcyclohexanes; b) a polylactone such as polymers of ϵ-caprolactone and one of the above mentioned diols; c) a polycarbonate obtained, for example, by reacting one of the above-mentioned diols with diaryl carbonates or phosgene; or d) a polyether such as a polymer or copolymer of styrene oxide, propylene oxide, tetrahydrofuran, butylene oxide or epichlorohydrin;

$R_3$ is a phosphonate, carboxylate or sulfonate group; and $R_2$ is a diamine or diol having a molecular weight less than about 500. Suitable well known diamine chain extenders useful herein include ethylene diamine, diethylene triamine, propylene diamine, butylene diamine, hexamethylene diamine, cyclohexylene diamine, phenylene diamine, tolylene diamine, xylylene diamine, 3,3'-dinitrobenzidene, ethylene methylenebis(2-chloroaniline), 3,3'-dichloro-4,4'-biphenyl diamine. 2,6-diaminopyridine, 4,4'-diamino diphenylmethane, and adducts of diethylene triamine with acrylate or its hydrolyzed products. Also included are materials such as hydrazine, substituted hydrazines such as, for example, dimethyl hydrazine, 1,6-hexamethylene-bis-hydrazine, carbodihydrazide, hydrazides of dicarboxylic acids and sulfonic acids such as adipic acid mono- or dihydrazide, oxalic acid dihydrazide, isophthalic acid dihydrazide, tartaric acid dihydrazide, 1,3-phenylene disulfonic acid dihydrazide, omega-amino-caproic acid dihydrazide, hydrazides made by reacting lactones with hydrazine such as gamma-hydroxylbutyric hydrazide, bis-semicarbazide, bis-hydrazide carbonic esters of glycols such as any of the glycols mentioned above. Suitable well known diol chain extenders may be any of the glycols or diols listed above for A. $R_3$ is a phosphonate, carboxylate or sulfonate group.

The number of repeating units of Structure I can range from 2 to 200, preferably 20 to 100. The amount of the hard-segment (in the right-hand parenthesis)is preferably 40 to 70 percent by weight. The weight ratio of the $OR_3O$ to the $OR_2O$ repeating unit preferably varies from 0 to 0.1. The water-dispersible polyurethane employed in the invention may be prepared as described in "Polyurethane Handbook," Hanser Publishers, Munich Vienna, 1985.

The term "polyurethane", as used herein, includes branched and unbranched copolymers, as well as IPN and semi-IPNs comprising at least two polymers, at least one of which is a polyurethane.

An IPN is an intimate combination of two or two or more polymers in a network, involving essentially(that may essentially involve) no covalent bonds or grafts between them. Instead, these intimate mixtures of polymers are held together by permanent entanglements produced when at least one of the polymers is synthesized in the presence of the other. Since there is usually molecular interpenetration of the polymers in IPNs, they tend to phase separate less compared to blends. Such interpenetrating polymer network systems and developments are described by L. H. Sperling in "Interpenetrating Polymer Networks and Related Materials," Plenum Press, New York, 1981, in pages 21–56 of "Multicomponent Polymer Materials" ACS Adv. In Chem. No. 211, edited by D. R. Paul and L. H. Sperling, ACS Books, Washington, D.C., 1986, and in pages 423–436 of "Comprehensive Polymer Science", Volume 6, "Polymer Reactions", edited by G. C. Eastmond, A. Ledwith, S. Russo, and P. Sigwalt, Pergamon Press, Elmsford, N.Y., 1989. While an ideal structure may involve optimal interpenetration, it is recognized that in practice phase separation may limit actual molecular interpenetration. Thus, an IPN may be described as having "interpenetrating phases" and/or "interpenetrating networks." If the synthesis or crosslinking of two or more of the constituent components is concurrent, the system may be designated a simultaneous interpenetrating network. If on the other hand, the synthesis and/or crosslinking are carried out separately, the system may be designated a sequential interpenetrating polymer network. A polymer system comprising two or more constituent polymers in intimate contact, wherein at least one is crosslinked and at least one other is linear is designated a semi-interpenetrating polymer network. For example, this type of polymer system has been formed in cured photopolymerizable systems such as disclosed in Chapter 7 of "Imaging Processes and Materials-Neblette's Eighth Edition," edited by J. M. Sturge, V. Walworth & A. Shepp, Van Nostrand Reinhold, New York, 1989.

In one embodiment of the present invention, the water-dispersible polymer is a polyurethane containing pH responsive groups such as acid functionalities and have an acid number greater than or equal to 5, preferably less than or equal to 40, more preferably less than or equal to 30, most preferably from 10 to 25. The weight ratio of the optional vinyl polymer in the polymer can vary from 0 to 80 percent, including a interpenetrating network of a urethane polymer and a vinyl polymer if the amount of vinyl polymer is substantially greater than zero.

In another embodiment of the present invention, the water-dispersible polymer is a polyurethane-containing component that is an IPN or semi-IPN comprising a polyurethane and a vinyl polymer. By the term "vinyl polymer" is meant an addition polymer that is the reaction product of ethylenically unsaturated monomers. Particularly preferred vinyl polymers are acrylics. Vinyls, especially acrylics, have the added advantage of good adhesion, non-yellowing, are adjustable for high gloss, and have a wide range of glass transition and minimum film forming temperatures. Polymerization of vinyl monomers in the presence of the polyurethane copolymer causes the two polymers to reside in the same latex particle as an interpenetrating or semi-interpenetrating network particle resulting in improved resistance to water, organic solvents and environmental conditions, improved tensile strength, and modulus of elasticity. The presence of groups such as carboxylic acid groups provide a conduit for processing solutions to permeate the coating at pH greater than 7. Preferably, the acid number is maintained at less than or equal to 40 to ensure that overcoat has good adhesion to the substrate below, even at high pH, and makes the overcoat more water-resistant.

A preferred IPN comprises an interpenetrating polyurethane and vinyl polymer. Such an IPN is also sometimes referred to in the trade as a urethane-vinyl copolymer or hybrid copolymer, even though involving essentially no chemical bonds between the two polymer chains. Such an IPN may be conventionally produced by polymerizing one or more vinyl monomers in the presence of the polyurethane prepolymer or a chain extended polyurethane. It is possible to have more than two polymers or for each of the polymer chains to be branched or linear. Suitably, in such an IPN, the weight ratio of polyurethane component to vinyl component is 1:20 to 20:1. The preferred weight ratio of the polyurethane to the vinyl component is about 4:1 to about 1:4, more preferably about 1:1 to 1:4.

Preferably, the polyurethane has an acid number of greater than or equal to 5, preferably less than or equal to 40, more preferably less than or equal to 30. Acid number is in general determined by titration and is defined as the number of milligrams of potassium hydroxide (KOH) required to neutralize 1 gram of the polymer.

Preparation of an aqueous dispersion of a polyurethane-containing component, when a single copolymer, is well known in the art. In a preferred method of preparation, the first step is the formation of a medium molecular weight isocyanate terminated prepolymer by the reaction of suitable di or polyol with a stoichiometric excess of di or polyisocyanates. The prepolymer is then generally dispersed in water via water-solubilizing/dispersing groups that are introduced either into the prepolymer prior to chain extension, or are introduced as part of the chain extension agent. Therefore, small particle size stable dispersions can frequently be produced without the use of an externally added surfactant. The prepolymer in the aqueous solution is then subjected to chain extension using diamines or diols to form the "fully reacted" polyurethane.

When a vinyl polymer is present in the polyurethane-containing component, such urethane-vinyl IPN copolymers may be produced, for example, by polymerizing one or more vinyl monomers in the presence of the polyurethane prepolymer or the chain extended polyurethane. The preferred weight ratio of the chain extended polyurethane to the vinyl monomer being about 4:1 to about 1:4, most preferably about 1:1 to 1:4, as mentioned above.

Polyols useful for the preparation of polyurethane dispersions of the present invention include polyester polyols prepared from one or more diols (e.g. ethylene glycol, butylene glycol, neopentyl glycol, hexane diol or mixtures of any of the above) and one or more dicarboxylic acids or anhydrides (succinic acid, adipic acid, suberic acid, azelaic acid, sebacic acid, phthalic acid, isophthalic acid, maleic acid and anhydrides of these acids), polylactone diols prepared from lactones such as caprolactone reacted with a diol, polyesteramides containing polyols prepared by inclusion of amino-alcohols such as ethanol amine during the polyesterification process, polyether polyols prepared from for example, ethylene oxide, propylene oxide or tetrahydrofuran, polycarbonate polyols prepared from reacting diols with diaryl carbonates, and hydroxyl terminated polyolefins prepared from ethylenically unsaturated monomers. Combinations of such polyols are also useful. As mentioned below, polysiloxane polyols are also useful in forming a polyurethane. See, for example, U.S. Pat. No. 5,876,910 to Anderson, hereby incorporated by reference, for such monomers. A polyester polyol is preferred for the present invention.

Polyisocyanates useful for making the prepolymer may be aliphatic, aromatic or araliphatic. Examples of suitable polyisocyanates include one or more of the following: toluene diisocyanate, tetramethylene diisocyanate, hexamethylene diisocyanate, isophorone diisocyanate, ethylethylene diisocyanate, 2,3-dimethylethylene diisocyanate, 1-methyltrimethylene diisocyanate, 1,3-cyclopentylene diisocyanate, 1,4-cyclohexylene diisocyanate, 1,3-phenylene diisocyanate, 4,4'-biphenylene diisocyanate, 1,5-naphthalene diisocyanate, bis-(4-isocyanatocyclohexyl)-methane, 4,4'-diisocyanatodiphenyl ether, tetramethyl xylene diisocyanate, polymethylene polyphenyl polyisocyanates and the like. Methylene bis(isocyanato cyclohexane) is preferred.

Preferably, a suitable portion of the prepolymer also contains at least one comparatively unreactive pendant carboxylic group, in salt form or preferably neutralized with a suitable basic material to form a salt during or after prepolymer formation or during formation of the dispersion. This helps provide permeability of processing solutions through the overcoat at pHs greater than 7 and dispersibility in water. Suitable compounds that are reactive with the isocyanate groups and have a group capable of forming an anion include, but are not limited to the following: dihydroxypropionic acid, dimethylolpropionic acid, dihydroxysuccinic acid and dihydroxybenzoic acid. Other suitable compounds are the polyhydroxy acids which can be prepared by oxidizing monosaccharides, for example gluconic acid, saccharic acid, mucic acid, glucuronic acid and the like. Such a carboxylic-containing reactant is preferably an $\alpha,\alpha$-dimethylolalkanoic acid, especially 2,2-dimethylol propionic acid.

Suitable tertiary amines which may be used to neutralize the acid and form anionic groups for water dispersability are trimethylamine, triethylamine, dimethylaniline, diethylaniline, triphenylamine and the like.

Chain extenders suitable for optionally chain extending the prepolymer are, for example, active-hydrogen containing molecules such as polyols, amino alcohols, ammonia, primary or secondary aliphatic, aromatic, alicyclic araliphatic or heterocyclic amines especially diamines. Diamines suitable for chain extension of the pre- polyurethane include ethylenediamine, diaminopropane, hexamethylene diamine, hydrazine, aminoethyl ethanolamine and the like.

In accordance with one embodiment of this invention, a urethane-vinyl IPN may be prepared by polymerizing vinyl addition monomers in the presence of the polyurethane prepolymer or the chain extended polyurethane. The solution of the water-dispersible polyurethane prepolymer in vinyl monomer may be produced by dissolving the prepolymer in one or more vinyl monomers before dispersing the prepolymer in water.

Suitable vinyl monomers in which the prepolymer may be dissolved contain one or more polymerizable ethylenically unsaturated groups. Preferred monomers are liquid under the temperature conditions of prepolymer formation, although the possibility of using solid monomers in conjunction with organic solvents is not excluded.

The vinyl polymers useful for the present invention include those obtained by copolymerizing one or more ethylenically unsaturated monomers including, for example, alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, the nitrile and amides of the same acids such as acrylonitrile, methacrylonitrile, and methacrylamide, vinyl acetate, vinyl propionate, vinylidene chloride, vinyl chloride, and vinyl aromatic compounds such as styrene, t-butyl styrene and vinyl toluene, dialkyl maleates, dialkyl itaconates, dialkyl methylene-malonates, isoprene, and butadiene. Suitable ethylenically unsaturated monomers containing carboxylic acid groups include acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrene carboxylic acid. Suitable polyethylenically unsaturated monomers include butadiene, isoprene, allylmethacrylate, diacrylates of alkyl diols such as butanediol diacrylate and hexanediol diacrylate, divinyl benzene and the like.

The prepolymer/vinyl monomer solution may be dispersed in water using techniques well known in the art. Preferably, the solution is added to water with agitation or, alternatively, water may be stirred into the solution. Polymerization of the vinyl monomer or monomers is brought about by free radical initiators at elevated temperatures.

Free radicals of any sort may be used including persulfates (such as ammonium persulfate, potassium persulfate, etc., peroxides (such as hydrogen peroxide, benzoyl peroxide, cumene hydroperoxide, tertiary butyl peroxide, etc.), azo compounds (such as azobiscyanovaleric acid, azoisobutyronitrile, etc.), and redox initiators (such as hydrogen peroxide-iron(II) salt, potassium persulfate-sodium hydrogen sulfate, etc.). Preferable free radical initiators are the ones that partition preferably into the oil phase such as the azo-type initiators. Common chain transfer agents or mixtures thereof known in the art, such as alkylmercaptans, can be used to control the polymer molecular weight.

Polymerization may be carried out by various methods. In one method, all of the vinyl monomer (the same or different vinyl monomers or monomer mixtures) is added in order to swell the polyurethane prepolymer. The monomers are then polymerized using an oil soluble free radical initiator after dispersing the mixture in water.

In a second alternative method, some of vinyl monomer may be added to swell the pre-polymer prior to dispersing in water. The rest of the monomer is fed into the system during the polymerization process. Other methods include feeding in all the vinyl monomer during the copolymerization process.

Some examples of polyurethane-containing polymers used in the practice of this invention that are commercially available include NeoPac® R-9000, R-9699 and R-9030 from NeoResins (a division of Avecia), Sancure® AU4010 from BF Goodrich (Akron, Ohio), and Flexthane® 620, 630, 790 and 791 from Air Products. An example of the polyurethane-containing copolymer useful in the practice that is commercially available is the NeoRez® R9679, from Avecia.

In another embodiment of the invention, the water-dispersible polymer, substantially amorphous, thermoplastic polyester polymer in which ionic groups or moieties are present in sufficient number to provide water dispersibility prior to coating. The polyester dispersions provide advantageous properties such as good film-formation, good chemical-resistance, wet-abrasion resistance, excellent fingerprint resistance, toughness, elasticity and durability. Furthermore, the polyesters exhibit tensile and flexural strength and resistance to various oils.

Procedures for the preparation of polyester ionomers are described in U.S. Pat. Nos. 3,018,272; 3,563,942; 3,734,874; 3,779,993; 3,929,489; 4,307,174, 4,395,475, 5,939,355 and 3,929,489, the disclosures of which are incorporated herein by reference. The substantially amorphous polyesters useful in this invention comprise dicarboxylic acid recurring units typically derived from dicarboxylic acids or their functional equivalents and diol recurring units typically derived from diols. Generally, such polyesters are prepared by reacting one or more diols with one or more dicarboxylic acids or their functional equivalents (e.g. anhydrides, diesters or diacid halides), as described in detail in the cited patents. Such diols, dicarboxylic acids and their functional equivalents are sometimes referred to in the art as polymer precursors. It should be noted that, as known in the art, carbonylimino groups can be used as linking groups rather than carbonyloxy groups. This modification is readily achieved by reacting one or more diamines or amino alcohols with one or more dicarboxylic acids or their functional equivalents. Mixtures of diols and diamines can be used if desired.

Conditions for preparing the polyesters useful in this invention are known in the art as described above. The polymer precursors are typically condensed in a ratio of at least 1 mole of diol for each mole of dicarboxylic acid in the presence of a suitable catalyst at a temperature of from about 125° to about 300° C. Condensation pressure is typically from about 0.1 mm Hg to about one or more atmospheres. Low-molecular weight by-products can be removed during condensation, e.g. by distillation or another suitable technique. The resulting condensation polymer is polycondensed under appropriate conditions to form a polyester. Polycondensation is usually carried out at a temperature of from about 150° to about 300° C. and a pressure very near vacuum, although higher pressures can be used.

Polyester ionomers, useful in the present composition, contain at least one ionic moiety, which can also be referred to as an ionic group, functionality, or radical. In a preferred embodiment of the invention, the recurring units containing ionic groups are present in the polyester ionomer in an amount of from about 1 to about 12 mole percent, based on the total moles of recurring units. Such ionic moieties can be provided by either ionic diol recurring units and/or ionic dicarboxylic acid recurring units, but preferably by the latter. Such ionic moieties can be anionic or cationic in nature, but preferably, they are anionic. Exemplary anionic ionic groups include carboxylic acid, sulfonic acid, and disulfonylimino and their salts and others known to a worker of ordinary skill in the art. Sulfonic acid ionic groups, or salts thereof, are preferred.

One type of ionic acid component has the structure

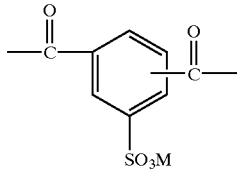

where M=H, Na, K or $NH_4$.

Ionic dicarboxylic acid recurring units can be derived from 5-sodiosulfobenzene-1,3-dicarboxylic acid, 5-sodiosulfocyclohexane-1,3-dicarboxylic acid, 5-(4-sodiosulfophenoxy)benzene-1,3-dicarboxylic acid, 5-(4-sodiosulfophenoxy)cyclohexane-1,3-dicarboxylic acid, similar compounds and functional equivalents thereof and others described in U.K. Patent Specification No. 1,470,059 (published Apr. 14, 1977). Other suitable polyester ionomers for protective overcoats in the imaged elements of the present invention are disclosed in U.S. Pat. Nos. 4,903,039 and 4,903,040, which are incorporated herein by reference.

Another type of ionic dicarboxylic acid found useful in the practice of this invention are those having units represented by the formula:

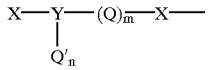

wherein each of m and n is 0 or 1 and the sum of m and n is 1; each X is carbonyl; Q has the formula:

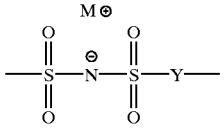

Q' has the formula:

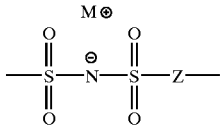

Y is a divalent aromatic radical, such as arylene (e.g. phenylene, naphthalene, xylylene, etc.) or arylidyne (e.g. phenenyl, naphthylidyne, etc.); Z is a monovalent aromatic radical, such as aryl, aralkyl or alkaryl (e.g. phenyl, p-methylphenyl, naphthyl, etc.), or alkyl having from 1 to 12 carbon atoms, such as methyl, ethyl, isopropyl, n-pentyl, neopentyl, 2-chlorohexyl, etc., and preferably from 1 to 6 carbon atoms; and M is a solubilizing cation and preferably a monovalent cation such as an alkali metal or ammonium cation.

As indicated above, in one preferred embodiment, the overcoat formulation used in this invention comprises 30 to 95% by weight (based on the dry laydown of the overcoat) of water-dispersible polymer particles of 0.01 to 0.5 micrometers in average size and 5 to 70% by weight of a hydrophilic polymer which is substantially uncrosslinked (based on the dry laydown of the overcoat). The use of less than 5% by weight of crosslinked gelatin or other crosslinked hydrophilic polymer in the overcoat (as applied) promotes coalescence during the heating step. It is noted that some gelatin from underlying layers in the photographic element may migrate into the overcoat, during manufacture or photochemical processing, for example, but any such migration is limited and, by definition, is not included in the described composition formulation or in the applied overcoat. In one embodiment, less than 5%, more preferably less than 3%, by weight of solids, of gelatin is included in the overcoat composition. Most preferably, essentially no gelatin is included in the overcoat formulation.

In another preferred embodiment, the present method involves a method of making a photographic element that comprises: (a) a support; (b) at least one silver-halide emulsion layer superposed on a side of said support; and (c) overlying the silver emulsion layer, a processing-solution-pertneable protective overcoat having a laydown of at least 0.54 g/m$^2$ (50 mg/ft$^2$) made from a formulation comprising less than 5%, by weight of solids, of crosslinked gelatin and further comprising 30 to 95% by weight of solids, preferably 60 to 90 weight percent, of water-dispersible polymer particles having an average particle size of less than 500 nm and a $T_g$ between −40 to 80° C., preferably 10° C. to 60° C., and 5 to 70%, by weight of solids, preferably 10 to 40 weight percent, of a water-soluble hydrophilic polymer such that more than 30 weight percent of the water-soluble polymer is washed out during photographic processing; wherein the weight ratio of the water-dispersible polymer to the non-crosslinked hydrophilic polymer is between 50:50 to 90:10, preferably 60:40 to 85:15, whereby the overcoat forms a water-resistant overcoat after photoprocessing without fusing, namely by maintaining the photographic element at temperature less than 100° C.

In accordance with this invention, the protective overcoat preferably comprises, in addition to the water-dispersible polymer described above, at least one water-soluble hydrophilic polymer. Examples of such water-soluble polymers that may be added include polyvinyl alcohol, cellulose ethers, poly(N-vinyl amides), polyacrylamides, polyesters, poly(ethylene oxide), dextrans, starch, uncrosslinked gelatin, whey, albumin, poly(acrylic acid), poly(ethyl oxazolines), alginates, gums, poly(methacrylic acid), poly (oxymethylene), poly(ethyleneimine), poly(ethylene glycol methacrylate), poly(hydroxy-ethyl methacrylate), poly (vinyl methyl ether), poly(styrene sulfonic acid), poly (ethylene sulfonic acid), poly(vinyl phosphoric acid) and poly(maleic acid) and the like. Such materials are included in "Handbook of Water-Soluble Gums and Resins" by Robert I. Davidson (McGraw-Hill Book Company, 1980) or "Organic Colloids" by Bruno Jirgensons (Elsvier Publishing Company, 1958). In a preferred embodiment, the polymer is polyvinyl alcohol, which polymer has been found to yield coatings that are relatively uniform and to enhance the diffision rate of the developer into the underlying emulsions.

The preferred hydrophilic polymer is polyvinyl alcohol. The term "polyvinyl alcohol" referred to herein means a polymer having a monomer unit of vinyl alcohol as a main component. Polyvinyl alcohol is typically prepared by substantial hydrolysis of polyvinyl acetate. Such a "polyvinyl alcohol" includes, for example, a polymer obtained by hydrolyzing (saponifying) the acetate ester portion of a vinyl acetate polymer (exactly, a polymer in which a copolymer of vinyl alcohol and vinyl acetate is formed), and polymers obtained by saponifying a trifluorovinylacetate polymer, a vinyl formate polymer, a vinyl pivalate polymer, a tert-butylvinylether polymer, a trimethylsilylvinylether polymer, and the like (the details of "polyvinyl alcohol" can be referred to, for example, "World of PVA", Edited by the Poval Society and Published by Kobunshi Kankoukai, Japan, 1992 and "Poval", Edited by Nagano et al. and Published by Kobunshi Kankoukai, Japan, 1981). The degree of hydrolysis (or saponification) in the polyvinyl alcohol is preferably at least about 70% or more, more preferably at least about 80%. Percent hydrolysis refers to mole percent. For example, a degree of hydrolysis of 90% refers to polymers in which 90 mol % of all copolymerized monomer units of the polymer are vinyl alcohol units. The remainder of all monomer units consists of monomer units such as ethylene, vinyl acetate, vinyl trifluoroacetate and other comonomer units which are known for such copolymers. Most preferably, the polyvinyl alcohol has a weight average molecular weight (MW) of less than 150,000, preferably less than 100,000, and a degree of hydrolysis greater than 70%. If the MW is greater than 100,000, the degree of hydrolysis is preferably less than 95%. Preferably, the degree of hydrolysis is 85 to 90% for a polyvinyl alcohol having a weight average MW of 25,000 to 75,000. These preferred limitations may provide improved manufacturability and processibility. The polyvinyl alcohol is selected to make the coating wettable, readily processable, and in a substantial amount, to readily, not sluggishly, come out of the coating during processing, thereby yielding the final water-resistant product. The optimal amount of polyvinyl alcohol depends on the amount of dry coverage of water-dispersible polymer. In one preferred embodiment of the invention, the polyvinyl alcohol is present in the overcoat in the amount between 1 and 60 weight percent of the water-dispersible polymer, preferably between 5 and 50 weight percent of the water-dispersible polymer, most preferably between 10 and 45 weight percent of the water-dispersible polymer.

The optimal amount of the water-soluble polymer may depend on the amount of dry coverage of water-dispersible polymer. For example, in the case of the combination of a polyurethane polymer and a polyvinyl alcohol polymer, if coverage of a polyurethane polymer is 1.08 g/m$^2$ (100 mg/ft$^2$) or less, then about 20% or less of polyvinyl alcohol, by weight of the polyurethane, provides good results, whereas for higher coverage, for example (1.88 g/m$^2$) 175 mg/ft$^2$, greater than about 25% of the polyvinyl alcohol provides comparably good results.

Without wishing to be bound by theory, it is believed that the water-soluble polymer and water-dispersible polymer form a compatible mixture, which allows for the formation of a water-resistant overcoat without the need for fusing, merely elevated temperatures preferably up to about 60° C. It is believed that fusing is not required for several reasons: (a) the substantial absence of crosslinked gelatin and other such crosslinked polymers, and (b) the selection of a water-dispersible polymer that is believed to form a compatible mixture with the hydrophilic water-soluble polymer, c) the selection of a water soluble polymer which is believed to be washed out during processing such that a water-resistant overcoat is formed.

If the protective overcoat is on the viewing side of the imaging element, it should be clear, i.e., transparent, and is preferably colorless. But it is specifically contemplated that the polymer overcoat can have some color for the purposes of color correction, or for special effects, so long as it does not detrimentally affect the formation or viewing of the image through the overcoat. Thus, there can be incorporated into the polymer a dye that will impart color or tint. In addition, additives can be incorporated into the polymer that will give the overcoat various desired properties. For example, a UV absorber may be incorporated into the polymer to make the overcoat UV absorptive, thus protecting the image from UV induced fading. Other compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer. In co-filed commonly assigned application U.S. Ser. No. 09/844,230, a protective non-gelatin layer is present on the non-viewing side. In this case, the optical requirements of the layer may be quite different. For example, in order to achieve the reflectivity for print viewing, the non-gelatin, may be opaque.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol OT), and alkylcarboxylate salts such as sodium decanoate.

The surface characteristics of the overcoat are in large part dependent upon the physical characteristics of the polymers which form the continuous phase and the presence or absence of solid, nonfusible particles. However, the surface characteristics of the overcoat also can be modified by the conditions under which the surface is optionally fused. For example, in contact fusing, the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

Matte particles well known in the art may also be used in the coating composition of the invention, such matting agents have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfinic acid, active methylene, amino, amide, allyl, and the like.

In order to reduce the sliding friction of the photographic elements in accordance with this invention, the water-dispersible polymers may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955, 061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284, 294; (3) liquid paraffin and paraffin or wax like materials such as carnauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, and the like. Lubricants useful in the present invention are described in further detail in *Research Disclosure* No.308119, published December 1989, page 1006.

The support material used with this invention can comprise various polymeric films, papers, glass, and the like. The thickness of the support is not critical. Support thicknesses of 2 to 15 mils (0.002 to 0.015 inches) can be used. Biaxially oriented support laminates can be used with the present invention. These supports are disclosed in commonly owned U.S. Pat. Nos. 5,853,965, 5,866,282, 5,874, 205, 5,888,643, 5,888,681, 5,888,683, and 5,888,714, incorporated in their entirety by reference herein. These supports include a paper base and a biaxially oriented polyolefin sheet, typically polypropylene, laminated to one or both sides of the paper base. At least one photosensitive silver halide layer is applied to the biaxially oriented polyolefin sheet.

The coverage of the overcoat will depend on its field of application. For a photographic element, the dry coverage of the polyurethane-containing copolymer in a protective overcoat is suitably at least 0.54 g/m$^2$ (50 mg/ft$^2$), preferably 1.08 to 5.38 g/m$^2$ (100 to 500 mg/ft$^2$), most preferably 1.61 to 3.23 g/m$^2$ (150 to 300 mg/ft$^2$). It may be advantageous to increase the amount of polyvinyl alcohol in the overcoat as the laydown increases in order to improve the developability. In the event of cracking of the overcoat, especially at lower levels of polyvinyl alcohol or when using an alternative film-forming polymer, it may be advantageous to adjust the temperature and/or humidity of the drying step to eliminate or reduce this cracking problem.

Photographic elements can contain conductive layers incorporated into multilayer photographic elements in any of various configurations depending upon the requirements of the specific photographic element. Preferably, the conductive layer is present as a subbing or tie layer underlying a magnetic recording layer on the side of the support opposite the photographic layer(s). However, conductive layers can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the photographic layer(s) or on both sides of the support. An optional conductive subbing layer can be applied either underlying or overlying a gelatin subbing layer containing an antihalation dye or pigment. Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of a photographic element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the photographic layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Conductive layers underlying a transparent magnetic recording layer typically exhibit an internal resistivity of less than $1\times10^{10}$ ohms/square, preferably less than $1\times10^{9}$ ohms/square, and more preferably, less than $1\times10^{8}$ ohms/square.

Photographic elements can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure,* Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure,* Vol. 176, Item 17643 (December, 1978).

Photographic elements protected in accordance with this invention may be derived from silver-halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion-picture prints or they can be imaged elements that are viewed by reflection, such a paper prints. Because of the amount of handling that can occur with paper prints and motion picture prints, they are the preferred imaged photographic elements for use in this invention.

While one purpose of applying an overcoat to imaged elements in accordance with this invention is to protect the element from physical damage, application of the overcoat may also protect the image from fading or yellowing. This is particularly true with elements that contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

Photographic elements in which the images to be protected are formed can have the structures and components shown in Research Disclosures 37038 and 38957. Other structures which are useful in this invention are disclosed in commonly owned U.S. Ser. No. 09/299,395, filed Apr. 26, 1999 and U.S. Ser. No. 09/299,548, filed Apr. 26, 1999, incorporated in their entirety by reference. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The photographic element can contain additional layers, such as filter layers, interlayers, overcoat layers, subbing layers, and the like. All of these can be coated on a support that can be transparent (for example, a film support) or reflective (for example, a paper support). Photographic elements protected in accordance with the present invention may also include a magnetic recording material as described in *Research Disclosure,* Item 34390, November 1992, or a transparent magnetic recording layer such as a layer containing magnetic particles on the underside of a transparent support as described in U.S. Pat. Nos. 4,279,945 and 4,302,523.

Suitable silver-halide emulsions and their preparation, as well as methods of chemical and spectral sensitization, are described in Sections I through V of Research Disclosures 37038 and 38957. Others are described in U.S. Ser. No. 09/299,395, filed Apr. 26, 1999 and U.S. Ser. No. 09/299,548, filed Apr. 26, 1999, which are incorporated in their entirety by reference herein. Color materials and development modifiers are described in Sections V through XX of Research Disclosures 37038 and 38957. Vehicles are described in Section II of Research Disclosures 37038 and 38957, and various additives such as brighteners, antifoggants, stabilizers, light absorbing and scattering materials, hardeners, coating aids, plasticizers, lubricants and matting agents are described in Sections VI through X and XI through XIV of Research Disclosures 37038 and 38957. Processing methods and agents are described in Sections XIX and XX of Research Disclosures 37038 and 38957, and methods of exposure are described in Section XVI of Research Disclosures 37038 and 38957.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process,* 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

During photoprocessing, the photographic element is preferably developed in an alkaline developer solution having a pH greater than 7, preferably greater than 8, more preferably greater than 9. This allows the developer to penetrate the protective coating. After the pH is reduced, for example in a bleach fix solution, the protective overcoat becomes relatively water resistant. The addition of polyvinyl alcohol and/or other hydrophilic polymers, according to one embodiment of the present invention, facilitates the present method. For example, it has been found polyvinyl alcohol polymer can provide improved wettability of the surface during processing and, at the same time, allows more of the polyvinyl alcohol to be washed out during the processing, so that the final product is more water resistant. Suitably at least 30%, preferably greater than 50%, more preferably greater than 75% of the original amount of a hydrophilic polymer in the overcoat is washed out during processing of the exposed photographic element, such that the final product is depleted in hydrophilic polymer and hence relatively more water resistant.

Preferably, in the case of a protective overcoat, it has been found that stain resistance and/or water resistance of an imaged element having a protective overcoat can be enhanced, when the overcoat (nascently protective) is coated simultaneously with the gelatin-based emulsion layers, by subjecting the product, after it emerges from the last photoprocessing step, to an elevated temperature, above 160° F. for a given period of time. This can involve a sustained period of time beyond minimal drying of the photographic element, such that the temperature of photographic element can reach or approach said elevated temperature. This drying of the image element at elevated temperatures facilitates coalescence of the latex in the overcoat, thus rendering the product more resistant to staining and/or water. A polymeric latex protective overcoat when coated simultaneously with underlying emulsion layers in a so-called single pass operation, as described herein, during manufacture of a photographic imaging element, has been found not to deliver the same stain protection features observed when coated separately in a so-called "two-pass" coating operation. Without wishing to be bound by theory, it is believed that some water soluble components from the adjacent imaging layers travel to the overcoat and, thus, making it difficult for the polymer latexes to form a continuous film and, thereby, preventing or decreasing coalescence of the latex in the final imaged product. Such high temperature treatment is applied to the imaging element, while it is wet, after it has gone through the three processing steps mentioned above. Preferably, the elevated temperature needs to be applied to the photographic element when it is at least 100% saturated with water.

The results show that a wide variety of polymers can be used in the non-gelatin layer. It is preferred that the Tg of the polymers be below 100° C. Preferred embodiments of the polymeric overcoat are disclosed, for example, in commonly assigned patent applications U.S. Ser. No. 09/235,436, 09/235,437, U.S. Pat. No. 6,194,130 B1, and U.S. Ser. No. 09/621,267, hereby incorporated by reference in their entirety.

In typical large scale photofinishing machines, the dryer settings can vary, depending on the length of the drier and the load (amount of material to be dried). If the length is short and/or the load is heavy, higher temperatures are typically used. However, because of the cost of drying energy, the driers are usually set, such that the product emerges just dry from the machine. In such operations, even though the drier temperature can be fairly high, the actual temperature that the wet web experiences is low, due to the high wet load. In conventional commercial practice, the typical temperature range is from 125–150° F.

Typically, traditional photoprocessing equipment can employ a wide variety of different dryers. Almost exclusively, however, the dryers operate by convective heating. That is, a heater is used to heat the air going into the dryer. This lowers the relative humidity of the air, which is then circulated by blowing it through the dryer sections. Several modes of circulation may be employed: co-current or counter-current to the direction of the web, or in a random fashion. Depending on the length of the dryer and the throughput of the web, the temperature of the air entering the dryer can be varied. The faster the drying rate desired, the higher will be the temperature of the air. Although, in the trade the temperatures presently employed typically range from 125 F. to 150° F., the temperature and residence time can be adjusted in accordance with the present invention.

Although convective drying is almost exclusively practiced in conventional equipment, other means of drying may be devised for use. These include heating belts, high temperature radiant sources or even by employing a mild vacuum. The most practical of these is to employ a radiant heat source. A radiant heat source can be placed next to the path of the web in the dryer. When the web passes by the heating source, the web temperature is raised, thereby driving the residual water from the web. Although, it is hard to measure a temperature of a radiant heat source, the most relevant temperature is the temperature that the web reaches. This can be measured by sticking a temperature sensitive label on the web. A combination of a convective drying and radiant drying can also be used, particularly to apply the higher temperature to facilitate latex coalescence towards the end of the drying cycle.

In a preferred embodiment, the dryer comprises both a convective heat section and a radiant heat section. Both heating sections heat from top and bottom. The convective heat section comprises a plurality of air vents on top and bottom, whereby hot air is blown through the vents onto the coating. Typically, there are two sets of rollers on each end of this section to move the coating through the dryer, and roller speed can be controlled in the range of about 0–3 inches per second. In a preferred embodiment, the radiant heat section comprises a quartz radiant heating tube on top and one below. A cabinet type dryer that has hot air circulating can also be used. In one embodiment, the photographic element is dried at the above-mentioned average elevated temperature for a period of time of 1 sec to 2 minutes, preferably 2 to 30 seconds, most preferably between 4 and 10 seconds. A drying step for improving overcoat properties is disclosed in commonly-assigned, copending application U.S. Ser. No. 09/844,050, hereby incorporated by reference.

Although the processing-solution-permeable overcoat does not require fusing, optional fusing may improve the water resistance further.

The overcoat layer in accordance with this invention is particularly advantageous for use with photographic prints due to superior physical properties including excellent resistance to water-based spills, fingerprinting, fading and yellowing, while providing exceptional transparency and toughness necessary for providing resistance to scratches, abrasion, blocking, and ferrotyping.

The present invention is illustrated by the following examples. Unless otherwise indicated, the molecular weights herein are weight average molecular weights, as determined by size exclusion chromotagraphy described below.

EXAMPLES

Polymers used in the non-gelatin layers in the following examples were prepared or obtained as follows.

P1 (Polyurethane-Acrylic Copolymer Dispersion)

Into a dry reactor was charged 96 grams of a diol (MILLESTER 9-55, MW2000 from Polyurethane Corporation of America), 87 grams of the methylene bis(4-cyclohexyl) isocyanate (DESMODUR W) and 0.02 grams of dibutyltin dilaurate (Aldrich). The mixture was held with stirring for 90 minutes at 94° C. under a blanket of argon after which 14 grams of dimethylol propionic acid was added to the reactor and the mixture stirred for 1.5 hours at 94° C. At this point 24 grams of methyl methacrylate were added and stirred for 1 hour at the same temperature. The resultant prepolymer was cooled to below 40° C., dissolved in a vinyl monomer mixture consisting of 113 grams of n-butyl acrylate, 188 grams of methyl methacrylate, and then treated with 11 grams of triethylamine and 2.5 grams of initiator (AIBN). To this mixture was added 1000 ml deoxygenated water followed by 10 grams of ethylene diamine in 20 grams of water. The dispersion was heated to 65° C., held there with stirring for 2 hours and heated further to 80° C. for 10 hours. The resulting dispersion of the urethane acrylic copolymer had an acid number of 11.

P2 (Polyurethane Dispersion)

In a 1 liter resin flask equipped with thermometer, stirrer, water condenser and a vacuum outlet, melted 75.68 grams (0.088 mole) polycarbonate polyol KM101733 (Mw=860) and dewatered under vacuum at 100° C. Released vacuum and at 40° C. added 10.25 grams (0.076 mole) of dimethylol propionic acid, 30.28 grams (0.336 mole) of 1,4-butanediol, 75 grams of tetrahydrofuran and 15 drops of dibutyltin dilaurate (catalyst) while stirring. Adjusted temperature to 75° C. when a homogeneous solution was obtained, slowly added 111.28 grams (0.50 mole) of isophorone diisocyanate followed by 25 grams of tetrahydrofuran. For this polymer, the monomer feed ratio on a weight basis was 33.3% polycarbonate polyol, 4.5% dimethylol propionic acid, 13.3% butanediol and 48.9% isophorone diisocyanate. After maintaining for about 4 hours to complete the reaction, NCO was substantially nil. Stirred in a stoichometric amount of potassium hydroxide based on dimethylol propionic acid, and maintained for 5 min. Mixed with 1300 grams of water under high shear to form a stable aqueous dispersion. Tetrahydrofuran was removed by heating under vacuum to give an aqueous dispersion at 19.1% solids. Glass transition temperature was 53° C. as measured by DSC, weight average molecular weight was 11,000 and particle size was 30 nm.

P3 (Polyester Ionomer Dispersion)

AQ-55, a polyester ionomer dispersion, was used as-received from Eastman Chemical Co. The Tg of this material was 55° C.

NEOREZ R9699 (P4) is a polyurethane acrylic latex obtained from NeoResins (a division of Avecia). NEOCRYLs A5090 (P5), A6092(P6) were acrylic latexxes obtained from NeoResins (a division of Avecia). They were used as with appropriate melt preparation.

Additional Materials

In addition to the polymer, the coating melt contained polyvinyl alcohol, which is needed for aiding the diffusion of processing solutions to the gelatin containing imaging layers. Different types of polyvinyl alcohol were used:

AIRVOL PVA203 has a MW of 12,000 and 88% degree of hydrolysis—manufactured by Air Products ELVANOL 52-22, has a MW of close to 100,000 and has a 88% degree of hydrolysis—manufactured by Dupont CX-100, a polyfunctional aziridine crosslinker for the polyurethane-acrylic copolymer dispersion, was obtained from Neo Resins (a division of Avecia). It was used in all coatings, at a level of 1% by weight with respect to the hydrophobic polymer. In addition to this, different types of thickeners were used:ACRYSOL ASE60—alkali swellable polymer latex made by Rohm and Haas LUVISKOL PVP K90—polyvinyl pyrollidinone, MW 90,000 made by BASF. Surfactants used were a mixture of di and tri isopropyl naphthalene sulfonate sold under the tradename Alkanol-XC and a second surfactant of FT248. The level of these surfactants in all the coating formulations was the same—0.17% of Alkanol-XC and 0.0585% of FT248.

Photographic Sample Preparation

Samples was prepared by coating in sequence blue-light sensitive layer, interlayer, green-light sensitive layer, UV layer, red-light sensitive layer, UV layer and overcoat on photographic paper support. The components in each individual layer are described below.

Blue Sensitive Emulsion (Blue EM-1)

A high chloride silver halide emulsion is precipitated by adding approximately equimolar silver nitrate and sodium chloride solutions into a well stirred reactor containing glutaryldiaminophenyldisulfide, gelatin peptizer and thioether ripener. Cesium pentachloronitrosylosmate(II) dopant is added during the silver halide grain formation for most of the precipitation, followed by the addition of potassium hexacyanoruthenate(II), potassium (5-methylthiazole)-pentachloroiridate, a small amount of KI solution, and shelling without any dopant. The resultant emulsion contains cubic shaped grains having edge length of 0.6 cm. The emulsion is optimally sensitized by the addition of a colloidal suspension of aurous sulfide and heat ramped to 60° C. during which time blue sensitizing dye BSD-4, potassium hexchloroiridate, Lippmann bromide and 1-(3-acetamidophenyl)-5-mercaptotetrazole were added.

Green Sensitive Emulsion (Green EM-1)

A high chloride silver halide emulsion is precipitated by adding approximately equimolar silver nitrate and sodium chloride solutions into a well stirred reactor containing, gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic shaped grains of 0.3 $\mu$m in edge length size. The emulsion is optimally sensitized by the addition of glutaryldiaminophenyldisulfide, a colloidal suspension of aurous sulfide and heat ramped to 55° C. during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (Red EM-1)

A high chloride silver halide emulsion is precipitated by adding approximately equimolar silver nitrate and sodium chloride solutions into a well stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4 $\mu$m in edgelength size. The emulsion is optimally sensitized by the addition of glutaryldiaminophenyldisulfide, sodium thiosulfate, tripotassium bis {2-[3-(2-sulfobenzamido)phenyl]-mercaptotetrazole} gold(I) and heat ramped to 64° C. during which time 1-(3-acetamidophenyl)-5-mercaptotetrazole, potassium hexachloroiridate, and potassium bromide are added. The emulsion is then cooled to 40° C., pH adjusted to 6.0 and red sensitizing dye RSD-1 is added.

Coupler dispersions were emulsified by methods well known in the art. The following imaging layers were coated in sequence on polyethylene-laminated photographic paper.

| Layer | Item | Laydown (mg/ft$^2$) |
|---|---|---|
| Layer 1 | Blue Sensitive Layer | |
| | Gelatin | 122.0 |
| | Blue sensitive silver (Blue EM-1) | 22.29 |
| | Y-4 | 38.49 |
| | ST-23 | 44.98 |
| | Tributyl Citrate | 20.24 |
| | ST-24 | 11.25 |
| | ST-16 | 0.883 |
| | Sodium Phenylmercaptotetrazole | 0.009 |
| | Piperidino hexose reductone | 0.2229 |
| | 5-chloro-2-methyl-4-isothiazolin-3-one/2-methyl-4-isothiazolin-3-one(3/1) | 0.019 |
| | SF-1 | 3.40 |
| | Potassium chloride | 1.895 |
| | Dye-1 | 1.375 |
| Layer 2 | Interlayer | |
| | Gelatin | 69.97 |
| | ST-4 | 9.996 |
| | Diundecyl phthalate | 18.29 |
| | 5-chloro-2-methyl-4-isothiazolin-3-one/2-methyl-4-isothiazolin-3-one(3/1) | 0.009 |
| | Catechol disulfonate | 3.001 |
| | SF-1 | 0.753 |
| Layer 3 | Green Sensitive Layer | |
| | Gelatin | 110.96 |
| | Green sensitive silver (Green EM-1) | 9.392 |
| | M-4 | 19.29 |
| | Oleyl Alcohol | 20.20 |
| | Diundecyl phthalate | 10.40 |
| | ST-1 | 3.698 |
| | ST-3 | 26.39 |
| | Dye-2 | 0.678 |
| | 5-chloro-2-methyl-4-isothiazolin-3-one/2-methyl-4-isothiazolin-3-one(3/1) | 0.009 |

-continued

| Layer | Item | Laydown (mg/ft$^2$) |
|---|---|---|
| | SF-1 | 2.192 |
| | Potassium chloride | 1.895 |
| | Sodium Phenylmercaptotetrazole | 0.065 |
| Layer 4 | M/C Interlayer | |
| | Gelatin | 69.97 |
| | ST-4 | 9.996 |
| | Diundecyl phthalate | 18.29 |
| | Acrylamide/t-Butylacrylamide sulfonate copolymer | 5.026 |
| | Bis-vinylsulfonylmethane | 12.91 |
| | 3,5-Dinitrobenzoic acid | 0.009 |
| | Citric acid | 0.065 |
| | Catechol disulfonate | 3.001 |
| | 5-chloro-2-methy1-4-isothiazolin-3-one/2-methyl-4-isothiazolin-3-one(3/1) | 0.009 |
| Layer 5 | Red Sensitive Layer | |
| | Gelatin | 125.96 |
| | Red Sensitive silver (Red EM-1) | 17.49 |
| | IC-35 | 21.59 |
| | IC-36 | 2.397 |
| | UV-1 | 32.99 |
| | Dibutyl sebacate | 40.49 |
| | Tris(2-ethylhexyl)phosphate | 13.50 |
| | Dye-3 | 2.127 |
| | Potassium p-toluenethiosulfonate | 0.242 |
| | 5-chloro-2-methyl-4-isothiazolin-3-one/2-methyl-4-isothiazolin-3-one(3/1) | 0.009 |
| | Sodium Phenylmercaptotetrazole | 0.046 |
| | SF-1 | 4.868 |
| Layer 6 | UV Overcoat | |
| | Gelatin | 76.47 |
| | UV-2 | 3.298 |
| | UV-1 | 18.896 |
| | STA | 6.085 |
| | SF-1 | 1.162 |
| | Tris(2-ethylhexyl)phosphate | 7.404 |
| | 5-chloro-2-methyl-4-isothiazolin-3-one/2-methyl-4-isothiazolin-3-one(3/1) | 0.009 |
| Layer 7 | SOC | |
| | Gelatin | 60.0 |
| | SF-1 | 1.0 |
| | SF-2 | 0.39 |

BSD-4

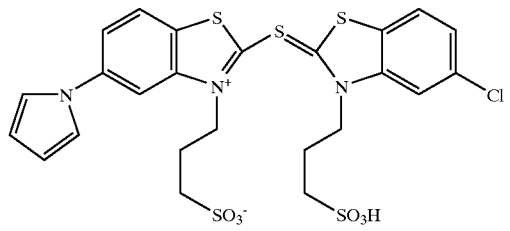

-continued
GSD-1
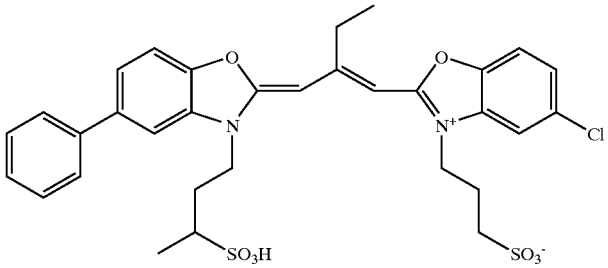
RSD-1
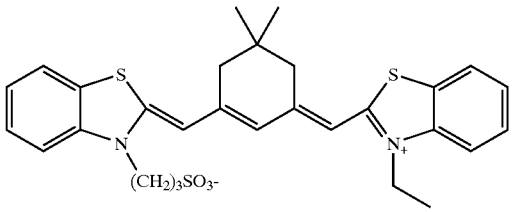
Y-4
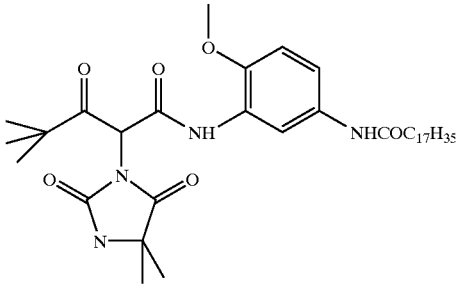
M-4
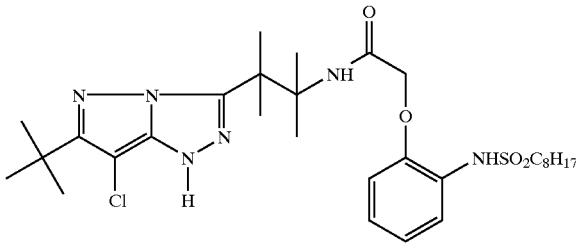
IC-35
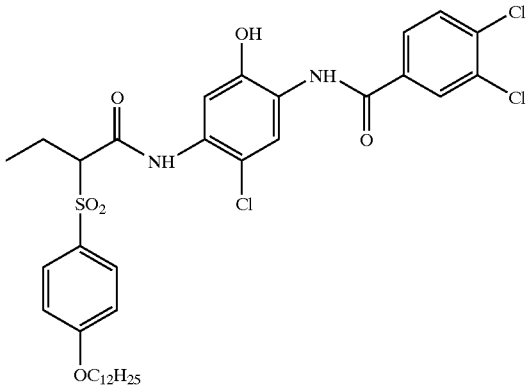

-continued
IC-36
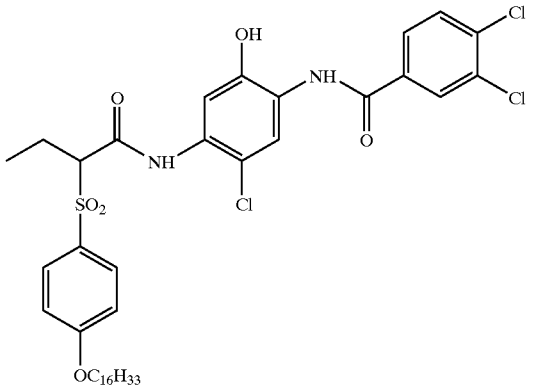
Dye-1
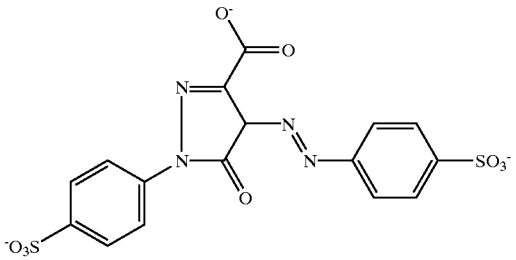
Dye-2
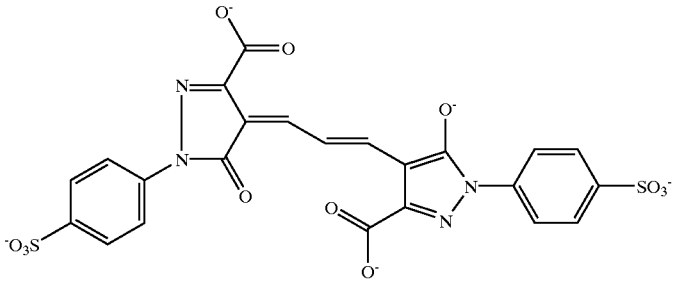
Dye-3
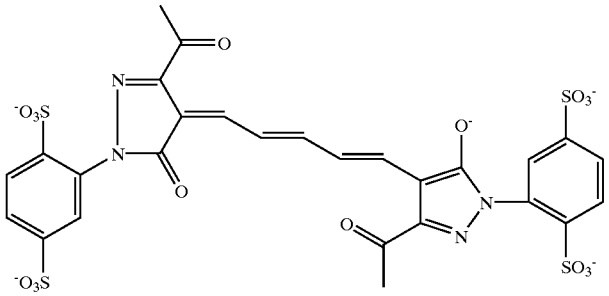
ST-1
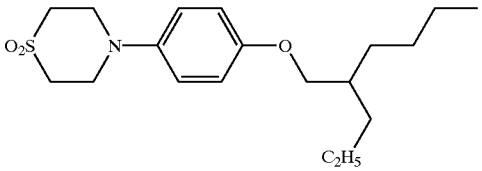
ST-3
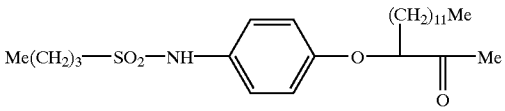

-continued
ST-4
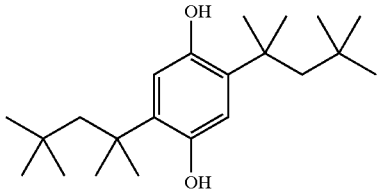
ST-16
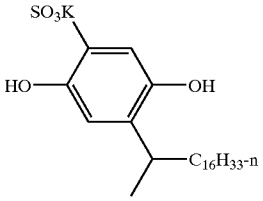
ST-23
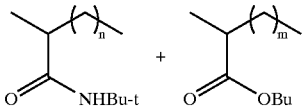
n:m = 1:1; MW = 75,000–100,000
ST-24
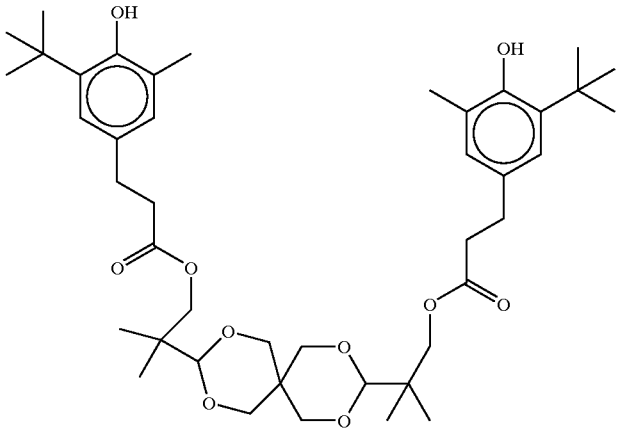
UV-1
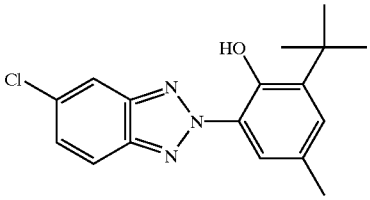
UV-2
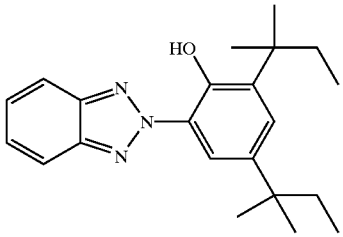

-continued

SF-1

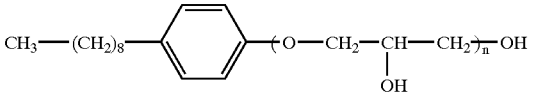

SF-2 $CF_3.(CF_2)_7SO_3Na$

Coating Method Description

A seven-layer imaging element was prepared by coating all seven layers simultaneously, employing a slide hopper and using a bead coating method. The six layers closest to the support comprised the layers of the Edge 8 product, except for the gelatin based overcoat. The said six layers comprised gelatin as the binder. The layer furthest from the support, which is the overcoat, comprised materials used in the protective overcoat of this invention. The prepared coating packs were bead coated onto a continuous web of either polyethylene terephthalate or resin coated paper using a seven slot slide hopper. The coating speed was between 60–90 fpm. The width of the coating on the web was 4". Immediately following the hopper, the web path is inclined about 20° for a residence time of 6–9 seconds.

There were two different coating pack structures with 7 layers in each. The six gelatin-containing layers were kept constant within each of the two pack structures. The viscosities and osmotic pressures of each layer were measured and recorded as described below. The weight percentage of gelatin in a given layer ("gel %") was used to quantify the gelatin concentration in a given layer.

The varying viscosity polyvinyl alcohols and the thickeners were used in different combinations so as to achieve a series of overcoat coating formulations whose osmotic pressure and viscosity could be varied independently. The viscosity and osmotic pressure data reported are the values of the individual melt prior to being coated on the slide. The layers were isothermally coated on the web at 40° C. All viscosities and osmotic pressure were measured at 40° C.

Measurement of Viscosity

Viscosity was measured using a Brookfield Cone and plate viscometer. The viscosity measurements reported were made at a shear rate of _7.50 to 37.50 sec-1_and temp of 40° C.

Ranking for Coating Defects

The coatings were evaluated and ranked based on the following standards.

Best

1 Uniform Coating

2 Very Slight Disturbance

3 Slight Disturbance; Layer structure still remains

4 Moderate Disturbance; Some layer structure damage

Worst

5 Severe Disturbance, Layer structure completely broken

Example 1

Six coating melt compositions were prepared for the lower six layers of the coating pack. The gelatin concentration and the wet thickness of each layer are giving in Table I below. The viscosity and osmotic pressure are also reported. The lower six layers were the same throughout the experiment. The overcoat layers were prepared individually and their composition was varied to produce coating formulations with different viscosities and osmotic pressures.

TABLE 1

| Layer | Thickness on Web (mil) | Gel Percent (weight %) | Viscosity @ 40° C. (cP) | Osmotic Pressure (psi) |
|---|---|---|---|---|
| Overcoat | Varied | 0 | Varied | Varied |
| Layer 6 | 0.126 | 16.0 | 164 | 5.9 |
| Layer 5 | 0.427 | 11.0 | 76 | 3.9 |
| Layer 4 | 0.178 | 16.1 | 164 | 6.2 |
| Layer 3 | 0.359 | 12.0 | 137 | 4.8 |
| Layer 2 | 0.178 | 16.1 | 164 | 6.2 |
| Layer 1 | 0.940 | 5.2 | 16 | 1.0 |

The seven layers were simultaneously bead coated at 60 feet/minute. The residence time on the 20° vertical rise was 9 seconds. The majority of this residence time is in a chill setting section with an air temperature of 50° F. The defects will not grow or change once the pack has been immobilized as a result of chill setting.

The coating composition of the overcoat layer and the experimental results are outlined in Table 2 below.

TABLE 2

| OC | Polymer | Melt composition | Coated Thickness (mil) | Viscosity @ 40° C. (cP) | Osmotic Pressure at 40° C. (psi) | Coating Quality Results |
|---|---|---|---|---|---|---|
| Adj. Gel layer | None | | 0.126 | 164 | 5.9 | — |
| OC1 | P1 | 20% P1 1.7% ELVANOL PVA | 0.370 | 9.1 | 0.8 | 5 |
| OC-2 | P1 | 30% P1 1.5% PVP-K90 | 0.370 | 21.6 | 1.4 | 5 |
| OC-3 | P2 | 20% P2 4% PVP-K90 | 0.370 | 33.7 | 1.8 | 5 |
| OC-4 | P2 | 20% P2 2% PVP-K90 2% PVA-203 | 0.370 | 30.6 | 1.9 | 4 |
| OC-5 | P1 | 20% P1 2% PVP-K90 1.5% PVA-203 | 0.370 | 45.2 | 2.8 | 3 |
| OC-6 | P3 | 20% P3 1.1% ELVANOL PVA | 0.370 | 43.6 | 2.9 | 3 |
| OC-7 | P3 | 20% P3 1.25% PVP-K90 | 0.370 | 72.4 | 3.0 | 3 |
| OC-8 | P3 | 20% P3 1% PVP-K-90 | 0.370 | 112 | 3.9 | 2 |

TABLE 2-continued

| OC | Polymer | Melt composition | Coated Thickness (mil) | Viscosity @ 40° C. (cP) | Osmotic Pressure at 40° C. (psi) | Coating Quality Results |
|---|---|---|---|---|---|---|
| | | 1% PVA-203 | | | | |
| OC-9 | P1 | 20% P1 7% PVA-203 | 0.370 | 140 | 4.8 | 1 |
| OC-10 | P5 | 17.5% P5 6.13% PVA-203 | 0.422 | 9.3 | 4.9 | 2 |
| 89OC-11 | P1 | 20% P1 7% PVA-203 0.29% ASE60 | 0.370 | 140 | 4.9 | 1 |
| OC-12 | P4 | 20% P4 7% PVA-203 | 0.370 | 65.6 | 5.0 | 1 |
| OC-13 | P6 | 20% P6 7% PVA-203 | 0.370 | 60.8 | 5.8 | 1 |
| OC-14 | P3 | 20% P3 7% PVA-203 | 0.370 | 128 | 6.8 | 1 |

The gelatin layer adjacent to the overcoat has a viscosity of 164 cp and an osmotic pressure of 5.9 psi. By changing the type of the polyvinyl alcohol and type of thickener, it was possible to have a wide variation in the osmotic pressure and viscosity of the overcoat coating formulations. As seen above, when the osmotic pressure of the overcoat is within 30% of the adjacent layer, the coating quality is 2 or better, even if the viscosity is varying substantially. This shows that it is critical to the coating quality for the osmotic pressure to be substantially close to that of the adjacent gelatin-containing layer.

Example 2

Coating compositions of the six gelatin-containing layers were similar except with respect to the water content of the melt. This coating pack is more dilute in general with respect to gelatin concentration. The gelatin concentration, viscosity and osmotic pressure are described in Table 3 below.

TABLE 3

| Layer | Thickness on Web (mil) | Gel Percent (weight %) | Viscosity @ 40° C. (cP) | Osmotic Pressure (psi) @ 40° C. |
|---|---|---|---|---|
| Overcoat | Varied | 0 | Varied | Varied |
| Layer 6 | 0.187 | 10.7 | 26 | 2.0 |
| Layer 5 | 0.548 | 8.6 | 26 | 2.7 |
| Layer 4 | 0.194 | 14.7 | 108 | 4.7 |
| Layer 3 | 0.500 | 9.0 | 43 | 3.2 |
| Layer 2 | 0.194 | 14.7 | 108 | 4.7 |
| Layer 1 | 1.047 | 4.5 | 11 | 0.9 |

As before, several variations of the overcoat were coated. The seven layers were simultaneously bead coated at 90 feet/minute. The residence time on the 20° vertical rise was 6 seconds. The majority of this residence time is in a chill setting section with an air temperature of 50° F. The defects will not grow or change once the pack has been immobilized as a result of chill setting.

The coating composition of the overcoat layer and the experimental results are outlined in Table 4 below.

TABLE 4

| OC | Polymer | Coating composition | Coated Thickness (mil) | Viscosity @ 40 C (cP) | Osmotic Pressure (psi) @ 40° C. | Coating Quality Results |
|---|---|---|---|---|---|---|
| Adj. Gel layer | None | | 0.187 | 26 | 2.0 | — |
| OC-15 | P2 | 18% PU 4.5% PVA-203 | 0.389 | 41.2 | 3.5 | 1 |
| OC-16 | P2 | 18% PU 4.5% PVA-203 | 0.370 | 50.8 | 4.9 | 2 |
| OC-17 | P4 | 20% P4 7% PVA-203 0.15% ASE60 | 0.814 | 105 | 5.1 | 1 |
| OC-18 | P3 | 20% P3 7% PVA-203 | 0.370 | 158 | 7.3 | 1 |

The gelatin layer adjacent to the overcoat has a viscosity of 26 cp and an osmotic pressure of 2.0 psi. By changing the type of the polymer, polyvinyl alcohol and thickener, it was possible to have a wide variation in the osmotic pressure and viscosity of the overcoat coating formulations. As seen above, when the osmotic pressure of the overcoat is greater than the adjacent layer, the coating quality is 2 or better, even if the viscosity is varying substantially. This shows that the coating quality is good when the osmotic pressure of the overcoat is up to 350% greater than the adjacent layer The invention has been described in detail with particular reference to certain preferred embodiments thereof, but it will be understood that variations and modifications can be effected within the spirit and scope of the invention.

What is claimed is:

1. A method for reducing the tendency toward formation of coating non-uniformities in the coating of a multilayer photographic element comprising the steps of:

(a) preparing coating compositions for a non-gelatin-containing layer and gelatin-containing layer, which layers comprise a layered mass suitable for coating on a moving web, which layered mass further comprises at least one silver-halide emulsion layer, wherein the osmotic pressure of the coating composition for the non-gelatin-containing layer is not more than 30 percent less than the osmotic pressure of the coating composition for the gelatin-containing layer, as measured at the temperature of coating;

(b) forming a laminar flow of the layered mass which includes said coating compositions as distinct layers, said non-gelatin-containing layer overlying and adjacent to said gelatin-containing layer, wherein said gelatin-containing layer is the topmost gelatin-containing layer in the layered mass; and (c) receiving said layered mass as a layered coating on a moving web comprising a photographic support, at a coating application point, wherein the layered mass, including the non-gelatin-containing layer and gelatin-containing layer, is simultaneously applied to the moving web with said silver-halide emulsion layer.

2. A method for reducing the tendency toward formation of coating non-uniformities in the coating of a multilayer photographic element comprising the steps of:

(a) preparing coating compositions for a non-gelatin-containing layer and a gelatin-containing layer, which layers comprise a layered mass suitable for coating on a moving web, which layered mass further comprises at least one silver-halide emulsion layer, wherein the non-gelatin-containing layer is a processing-solution-permeable overcoat overlying the silver-halide emulsion layer, said overcoat having a laydown of at least 0.54 g/m$^2$ (50 mg/ft$^2$), the coating composition for which comprises 30 to 95%, by weight of solids, of water-dispersible polymer in the form of particles having an average particle size of less than 500 nm and 5 to 70%, by weight of solids, of water-soluble polymer such that more than 30 weight percent of the water-soluble polymer is capable of being washed out during photographic processing, wherein the osmotic pressure of the composition for the non-gelatin-containing layer is not more than 30 percent less than the osmotic pressure of the coating for the gelatin-containing layer, as measured at the temperature of coating;

(b) forming a laminar flow of the layered mass which includes said compositions as distinct layers, said non-gelatin-containing layer overlying and adjacent to said gelatin-containing layer, wherein said gelatin-containing layer is the topmost gelatin-containing layer in the layered mass; and (c) receiving said layered mass as a layered coating on a moving web comprising a photographic support for the photographic element, at a coating application point, wherein the layered mass, including the contiguous non-gelatin-containing layer and gelatin-containing layer is simultaneously applied to the moving web with the silver-halide emulsion layer.

3. The method of claim 1 or 2 wherein the osmotic pressure of the non-gelatin-containing layer is less than the osmotic pressure of the gelatin-containing layer.

4. The method of claim 1 or 2 wherein the osmotic pressure of the non-gelatin-containing layer is 0.5 to 10 psi.

5. The method of claim 1 or 2 wherein the osmotic pressure of the non-gelatin-containing layer is not more than 20% less than the osmotic pressure of the gelatin layer.

6. The method of claim 1 or 2 wherein osmotic pressure of the coating composition for the non-gelatin layer is primarily controlled by means of the addition of a water-soluble polymer to the coating composition.

7. The method of claim 1 or 2 wherein the osmotic pressure of the coating composition for the non-gelatin-containing layer is primarily controlled by adding low molecular weight polyvinyl alcohol to coating composition.

8. The method of claim 1 or 2 wherein the osmotic pressure of the coating composition for the non-gelatin-containing layer is from 0.2 to 12 psi.

9. The method of claim 1 or 2 wherein the osmotic pressure of the coating composition for the gelatin-containing layer varies from 0.2 to 12 psi.

10. The method of claim 1 or 2 where said gelatin-containing layer is on the frontside of the photographic element and is a silver-halide emulsion layer or a UV protective layer.

11. The method of claim 1 or 2 wherein the coating composition for the non-gelatin-containing layer contains less than 1% gelatin by dry weight and the coating composition for the gelatin-containing layer contains more than 10% gelatin by dry weight.

12. The method of claim 1 or 2 wherein the viscosity of the coating composition for the non-gelatin-containing layer, when coating, is 5 to 250 cp.

13. The method of claim 1 wherein the gelatin-containing layer is on the backside of the photographic element and is a magnetic layer.

14. The method of claim 1, wherein the non-gelatin-containing layer is a protective layer.

15. A method according to claim 1 or 2, wherein said forming is on an inclined plane and said receiving is by beadcoating.

16. A method according to claim 1 or 2, wherein said forming is on an inclined plane and said receiving is by curtain coating.

17. The method of claim 2, wherein the weight ratio of water-dispersible polymer to water-soluble polymer is between 50:50 to 90:10 and the overcoat comprises less than 5% by weight of crosslinked gelatin in the applied overcoat.

18. The method of claim 2, wherein the $T_g$ of the water-dispersible polymer is between −40° C. and 80° C.

19. The method of claim 2, wherein the Tg of the polymers in the overcoat is below 100° C.

20. The method of claim 2 wherein said water-dispersible polymer is selected from the group consisting of polyesters, polyamides, polyurethanes, polyureas, polyethers, polycarbonates, polyacid anhydrides, vinyl urethane hybrid polymers derived from vinyl ethers, vinyl heterocyclic compounds, styrenes, olefins, halogenated olefins, unsaturated acids and esters thereof, unsaturated nitrites, acrylamides and methacrylamides, and vinyl ketones, poly (epoxides) and copolymers thereof, and combinations thereof.

21. The method of claim 2 wherein said water-dispersible polymer comprises ionized or ionizable groups.

22. The method of claim 2 wherein said water-soluble polymer is selected from the group consisting of polyvinyl alcohol, cellulose ethers, poly(N-vinyl amides), polyacrylamides, polyesters, poly(ethylene oxide), dextrans, starch, uncrosslinked gelatin, whey, albumin, poly(acrylic acid), poly(ethyl oxazolines), alginates, gums, poly (methacrylic acid), poly(oxymethylene), poly (ethyleneimine), poly(ethylene glycol methacrylate), poly (hydroxy-ethyl methacrylate), poly(vinyl methyl ether), poly(styrene sulfonic acid), poly(ethylene sulfonic acid), poly(vinyl phosphoric acid) and poly(maleic acid), and copolymers thereof, and combinations thereof.

23. The method of claim 22 wherein the weight average molecular weight of said water-soluble polymer is less than 300,000.

24. The method of claim 23 wherein the weight average molecular weight of said water-soluble polymer is 1500 to 100,000.

25. The method of claim 2 wherein said water-dispersible polymer has an acid number of greater than or equal to 5.

* * * * *